US006899489B2

(12) United States Patent
Smith

(10) Patent No.: US 6,899,489 B2
(45) Date of Patent: May 31, 2005

(54) PRE-FABRICATED WARPED PAVEMENT SLAB, FORMING AND PAVEMENT SYSTEMS, AND METHODS FOR INSTALLING AND MAKING SAME

(75) Inventor: Peter J. Smith, Gansevoort, NY (US)

(73) Assignee: Fort Miller Co., Inc., Greenwich, NY (US)

( * ) Notice: Subject to any disclaimer, the term of this patent is extended or adjusted under 35 U.S.C. 154(b) by 24 days.

(21) Appl. No.: 10/185,821

(22) Filed: Jun. 27, 2002

(65) Prior Publication Data

US 2003/0108388 A1 Jun. 12, 2003

Related U.S. Application Data

(60) Provisional application No. 60/339,703, filed on Dec. 12, 2001.

(51) Int. Cl.[7] ..... E01C 5/06; E01C 5/12

(52) U.S. Cl. ..... 404/35; 404/73; 404/34; 404/47; 404/40; 404/41; 52/596; 249/192

(58) Field of Search ..... 404/34, 35, 37, 404/40, 47, 49, 50, 51, 52, 61, 31, 60, 69, 126, 72, 75, 73, 26; 52/600, 596, 607, 574, 393; 249/2, 13, 188, 192; 406/31, 60, 69, 261

(56) References Cited

U.S. PATENT DOCUMENTS

| | | | | |
|---|---|---|---|---|
| 2,057,708 | A | * 10/1936 | Caye | |
| 2,180,842 | A | * 11/1939 | Winding | 249/5 |
| 3,157,098 | A | * 11/1964 | Mason | 249/5 |
| 3,344,608 | A | * 10/1967 | McEachran | |
| 3,595,518 | A | * 7/1971 | Gaudelli et al. | 249/163 |
| 3,599,542 | A | 8/1971 | Morrett, Jr. | |
| 3,712,187 | A | * 1/1973 | Stelling | |
| 3,923,410 | A | * 12/1975 | Jordan et al. | 404/41 |
| 4,067,941 | A | * 1/1978 | Gaudelli et al. | 264/69 |
| 4,228,985 | A | * 10/1980 | Gaudelli et al. | 249/93 |
| 4,428,562 | A | * 1/1984 | Carter | 256/17 |
| 4,660,344 | A | * 4/1987 | Gaudelli et al. | 52/592.1 |
| 4,958,964 | A | * 9/1990 | Soto et al. | 404/40 |
| 5,230,584 | A | * 7/1993 | Grossman | 404/41 |
| 5,383,742 | A | * 1/1995 | Grace | 404/15 |
| 5,410,851 | A | * 5/1995 | Restrepo | 52/381 |
| 5,957,619 | A | * 9/1999 | Kinoshita et al. | 404/31 |
| 6,020,073 | A | * 2/2000 | Wilson, Sr. | 428/489 |
| 6,052,964 | A | * 4/2000 | Ferm et al. | 52/742.14 |
| 6,340,267 | B1 | * 1/2002 | Kortmann | 404/2 |
| 6,464,199 | B1 | * 10/2002 | Johnson | 249/117 |
| 2001/0018006 | A1 | 8/2001 | Smith | |
| 2003/0231929 | A1 | * 12/2003 | Lee | 404/34 |

FOREIGN PATENT DOCUMENTS

| | | | | |
|---|---|---|---|---|
| GB | 0102214 | * 7/1984 | | E01C/5/00 |
| GB | 2221234 | A * 1/1990 | | E01C/5/06 |
| JP | P2000-192640 | A * 11/2000 | | |

* cited by examiner

*Primary Examiner*—Robert J. Sandy
*Assistant Examiner*—Katherine Mitchell
(74) *Attorney, Agent, or Firm*—Schmeiser, Olsen & Watts

(57) ABSTRACT

A pre-fabricated warped pavement slab and a forming system for making the slabs. The forming system includes a plurality of forming sections which can be adjusted so as to form a warped-plane pavement slab. Also disclosed are methods for making the pavement slab and forming system. Also disclosed is a method for installing the warped pavement slab.

17 Claims, 23 Drawing Sheets

PRE-FABRICATED WARPED PAVEMENT SLAB, FORMING AND PAVEMENT SYSTEMS, AND METHODS FOR INSTALLING AND MAKING SAME

This application claims benefit of provisional U.S. Application Ser. No. 60/339,303 filed Dec. 12, 2001.

BACKGROUND OF THE INVENTION

1. Technical Field

The present invention relates generally to roadway construction and repair, and more particularly, to the formation, installation and system for making and attaching a pre-fabricated warped pavement slab, and the warped slab so formed.

2. Related Art

Heretofore, attempts have been made to construct and install pre-fabricated or precast pavement slabs. However, most attempts have been unsuccessful due to a combination of factors. For example, it is difficult to prepare and maintain a perfectly smooth sub-grade which is necessary to uniformly support the slab. It is even more difficult to prepare a subgrade that is warped meeting profile and cross-slope changes normally encountered in roadway construction. Attempts to make a pre-fabricated pavement slab with an accurate and predictable warp have been unsuccessful. Likewise, it is difficult to connect adjacent slabs in a manner that uniformly transfers shear loading from one slab to the next. Heretofore attempts to prefabricate such pavement slabs have been of an experimental nature and have been entirely inadequate and inefficient. Accordingly, there exists a need in the industry for a pre-fabricated warped pavement slab and a method of installing the warped slab that solves these and other problems.

SUMMARY OF THE INVENTION

A first general aspect of the present invention provides an apparatus comprising: a pre-fabricated pavement slab formed of a hardenable, flowable material, wherein said pre-fabricated pavement slab is warped.

A second general aspect of the present invention provides a system for forming a pre-fabricated pavement slab comprising: a plurality of form sections for forming a hardenable, flowable material; and a device for adjusting a warp of the form sections.

A third general aspect of the present invention provides a method of marking a pre-fabricated pavement slab comprising: providing a plurality of form sections; adjusting a first portion of the plurality of form sections out of place with a second portion of the plurality of form sections; and placing a hardenable, flowable material onto the form sections.

A fourth general aspect of the present invention provides a method of making a prefabricated pavement slab forming system comprising: providing a plurality of form sections for forming hardenable, flowable material; and providing a device for adjusting a warp of the form sections.

A fifth general aspect of the present invention provides a method for installing a pre-fabricated warped pavement slab comprising: placing a pre-fabricated warped pavement slab on a graded subbase; and placing a binder material between a bottom surface of the warped slab and the graded subbase.

A sixth general aspect of the present invention provides a pavement system comprising: a graded subbase; a plurality of pre-fabricated warped pavement slabs placed on the graded subbase; a binder distribution system attached to a bottom surface of the plurality of pre-fabricated warped pavement slabs; and an interconnection system along edges of the plurality of pre-fabricated warped pavement slabs.

A seventh general aspect of the present invention provides a precision pre-fabricated warped pavement slab comprising: a pre-fabricated pavement slab formed of a hardenable, flowable material, wherein a top surface of the pavement slab is warped; and at least one edge of a cross section taken perpendicular to a longitudinal side is straight.

An eighth general aspect of the present invention provides a forming a plurality of prefabricated pavement slabs at a remote location; grading a subgrade; placing the prefabricated pavement slabs on the subgrade; and leveling at least one of the prefabricated pavement slabs with a flowable material.

The foregoing and other features of the invention will be apparent from the following more particular description of the embodiments of the invention.

BRIEF DESCRIPTION OF THE DRAWINGS

The embodiments of this invention will be described in detail, with reference to the following figures, wherein like designations denote like elements, and wherein.

DETAILED DESCRIPTION OF THE INVENTION

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc. Although the drawings are intended to illustrate the present invention, the drawings are not necessarily drawn to scale.

Figure 1:
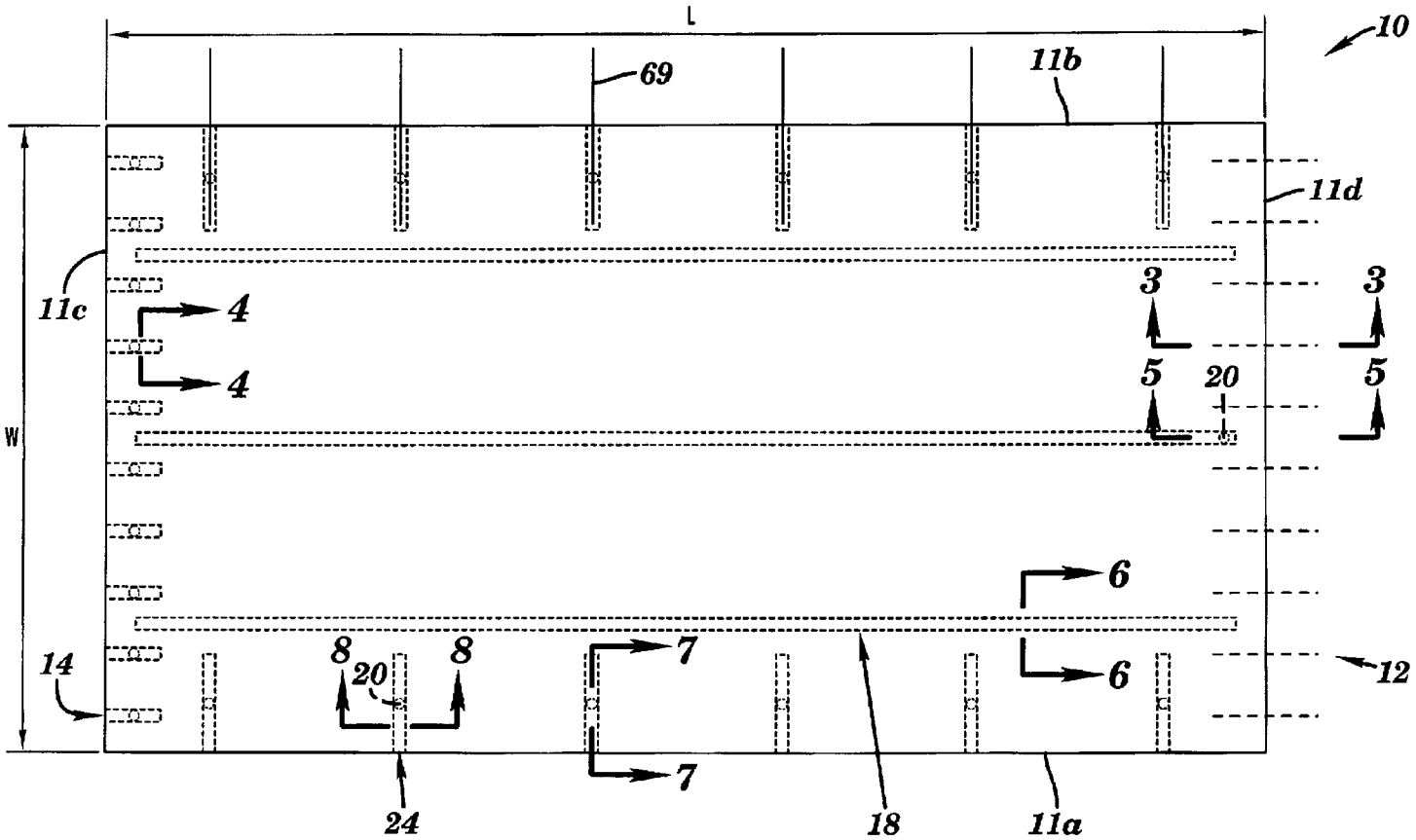
FIG. 1 depicts a plan view of a pre-fabricated pavement slab in accordance with the present invention.
Figure 15:
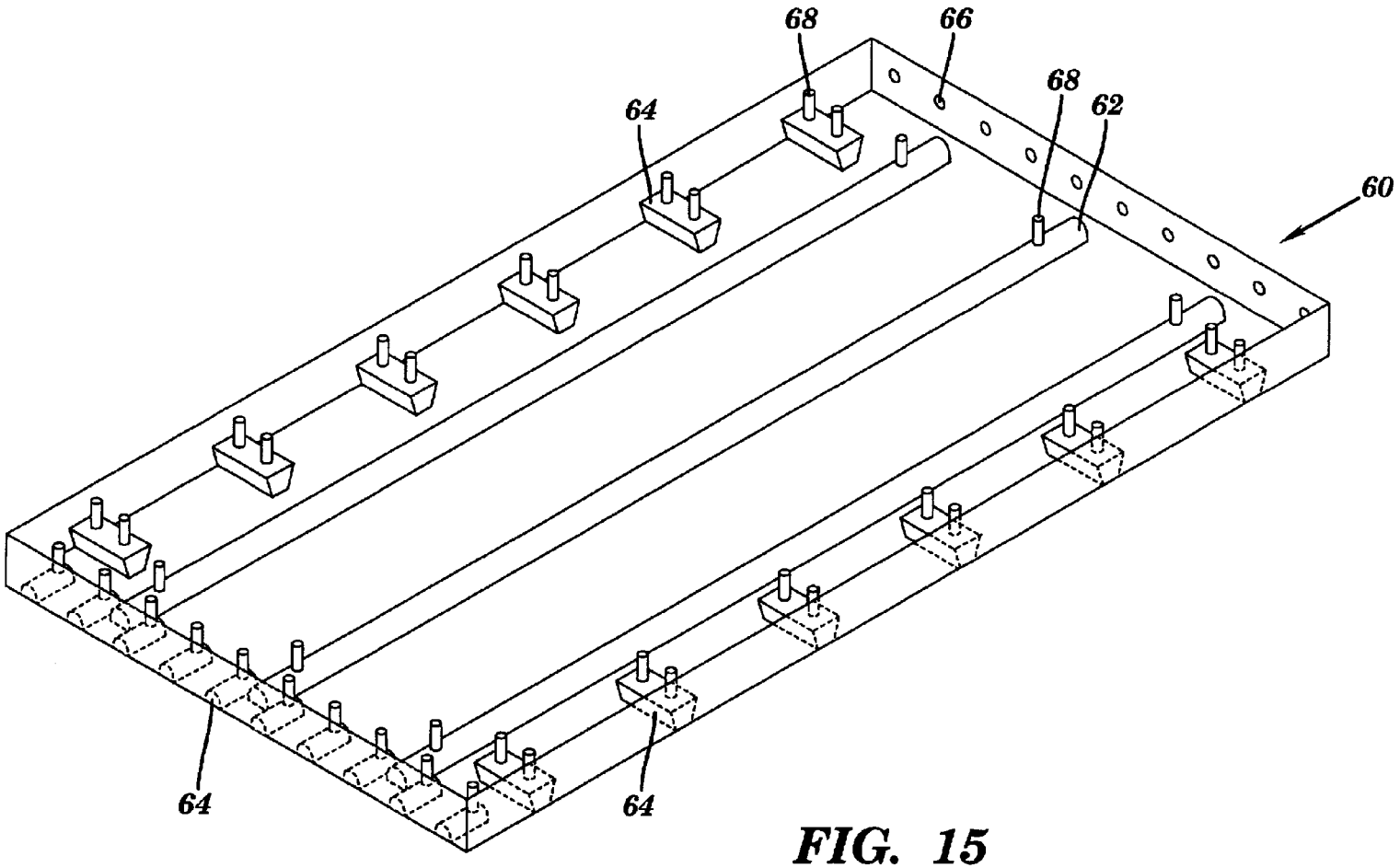
FIG. 15 depicts a form used to construct the slab in accordance with the present invention.

Referring to the drawings, FIG. 1 shows a plan view of a pre-fabricated pavement slab 10. The slab 10 may be constructed by pouring a pavement material, such as concrete, or other similarly used material, into a form 60, having a plurality of raised channel forming surfaces 62, raised slot forming surfaces 64, connector openings 66 and port forming surfaces 68 (refer to FIG. 15). The raised channel forming surfaces 62 may be independent from the raised slot forming surfaces 64. The slab 10 may be used in high traffic areas, such as highways, on/off ramps, airport runways, toll booth areas, etc. The pavement slab 10 can vary in length and width. The length of the pavement slab 10 can be in the range from 1 foot up to 18 feet. The width of the pavement slab 10, likewise, can vary from a width of 2 feet up to 12 feet wide. A typical pavement slab 10 for use in a highway roadway may be approximately 10–12 feet (3.049–3.658 m) wide W, as required by the New York State Department of Transportation, and approximately 18 feet (5.486 m) in length L, for example. Similarly, a pavement slab 10 which has dimensions of approximately 2 feet in length by a full roadway lane (e.g., 12 feet) wide can be installed to replace a damaged or deteriorated roadway joint. Additionally, a pavement slab 10 may have dimensions, for example, of approximately 2 feet in length by 2 feet in width, which would be useful as a roadway replacement patch. The slabs 10 may range in thickness T from approximately 9–12 inches. These dimensions, L, W, T, however, may vary as desired, needed or required and are only stated here as an example.

Figure 2:
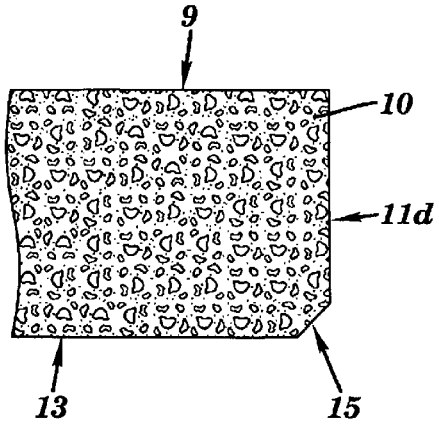
FIG. 2 depicts a cross-sectional view of the pre-fabricated pavement slab in accordance with the present invention.

The top surface 9 of the slab 10 is a roughened astroturf drag finish, while the sides 11*a*, 11*b*, 11*c*, 11*d*, and bottom surface 13 of the slab 10 have a substantially smooth finish (refer to FIG. 2, which shows a cross-sectional view of a corner of the slab 10). The bottom surface 13, the sides 11*a*, 11*b*, 11*c*, 11*d* of the slab 10 come together to form a chamfer 15 around the perimeter of the slab 10. The chamfer 15 prevents soil build-up between two mating slabs which may occur if the slab 10 is tipped slightly during installation.

The slab 10 further includes a plurality of connectors 12 that may comprise transverse slippable connecting rods or dowels. The plurality of connectors 12 may be embedded within an end of the slab 10. In one embodiment, the connectors 12 are post tensioned interconnections, as known and used in the industry, wherein multiple slabs may be connected in compression. The connectors 12 are spaced approximately 1 ft. apart along the width W of the slab 10, and comprise steel rods, or other similar material conventionally known and used. Each connector 12 is of standard dimensions, approximately 14 inches in length and 1.25 inches in diameter. The slippable connectors 12 are mounted truly parallel to the longitudinal axis L of the slab 10 to allow adjacent slabs 10 to expand and contract without inducing unwanted damaging stresses in the slabs 10. The connectors 12 [are preferentially] can be mounted such that approximately half of the connector 12 is embedded within the pavement slab 10 and half of the connector 12 extends from the side of the slab 10.

Figure 3:
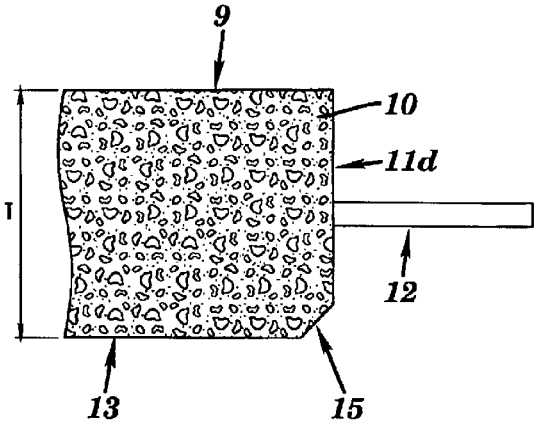
FIG. 3 depicts a cross-sectional view of a transverse dowel bar in accordance with the present invention.

FIG. 3 shows a cross-sectional view (along line A—A of FIG. 1) of the slab 10 and a connector 12 extending therefrom. As illustrated, the connectors 12 are embedded within the side 11*d* of the slab 10 at approximately the midpoint of the thickness T of the slab 10. The connectors 12 aid in transferring an applied shear load, i.e., from traffic, evenly from one slab 10 to the adjacent slab, without causing damage to the slab 10.

Figure 4A:
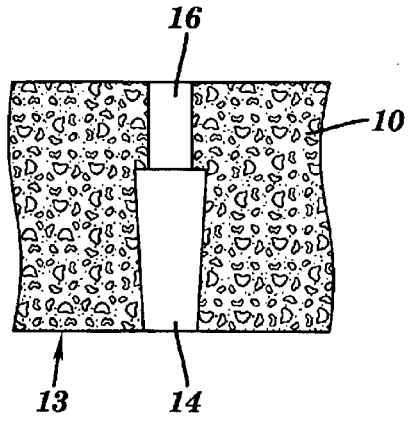
FIG. 4A depicts a cross-sectional view, taken along line 4—4 of FIG. 1, of a connector slot in accordance with embodiments of the present invention.

The slab 10 further includes a plurality of inverted interconnection slots 14 formed within the bottom surface 13 of the slab 10 at a side 11*c* thereof. Each interconnection slot 14 is sized to accommodate the connectors 12 extending from the side of an adjacent slab 10, thereby forming an interconnection between adjacent slabs once the slot 14 is filled around the connectors 12 with a binder material. FIG. 4A shows a cross-sectional view (along line B—B of FIG. 1) of an interconnection slot 14, wherein the slot 14 is wider at the top of the slot 14 than at the bottom of the slot 14. This wedged shape prevents the slab 10 from moving downward with respect to the adjacent slab with the application of a load once the binder material has reached sufficient strength.

Figure 4B:
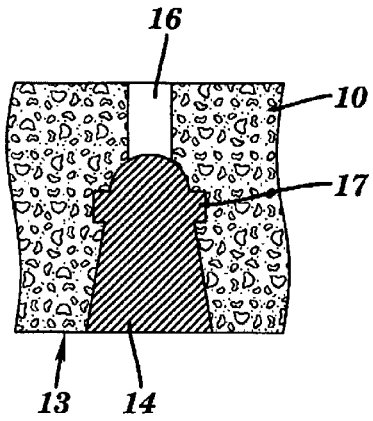
FIG. 4B depicts FIG. 4A using an alternative connector slot in accordance with embodiments of the present invention.
Figure 4C:
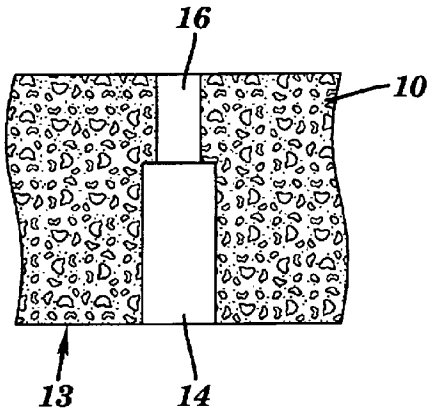
FIG. 4C depicts FIG. 4A using an alternative connector slot in accordance with embodiments of the present invention.

In the alternative, the interconnection slots 14 may take the form of a "mouse hole" having a pair of cut-outs or holes 17 formed on both sides thereof, as illustrated in FIG. 4B. In this case, when the slots 14 are filled with a binder material, the holes 17 form shear pins on the sides of the mouse hole that would have to be sheared in order for the slab 10 to move downward with respect to the adjacent slab. In the alternative, the slots 14 may have vertically oriented sides, as illustrated in FIG. 4C. In this case the sides of the slot 14 are sandblasted to provide a roughened surface, thereby frictionally limiting the ability of the slab 10 to move downward with respect to the adjacent slab.

As illustrated in FIGS. 4A–4C, each interconnection slot 14 further includes an opening, access or port 16. In particular, a binder material such as structural grout or concrete, a polymer foam material, or other similar material, may be injected within each port 16 thereby filling the interconnection slot 14 receiving the inserted connector 12 (not illustrated) to secure adjacent slabs end to end.

It has been previously noted that the connectors 12 are preferentially mounted as described above with approximately half of the connector 12 embedded in an adjacent slab while the other half is engaged and embedded in the interconnections slots 14 of slab 10. Alternatively, the same connector 12 may be preplaced on the subgrade, not shown, such that interconnections slots 14 in both slabs engage the connectors 12, such interconnection slots 14 being subsequently filled with binder material in the same manner described in the foregoing.

Figure 5:
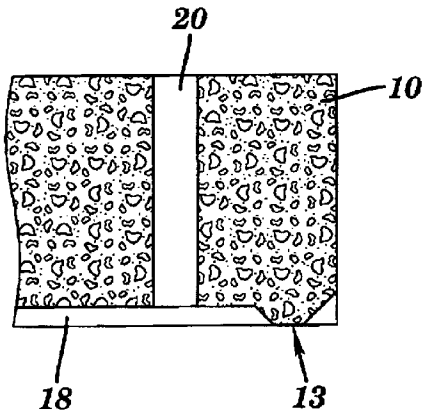
FIG. 5 depicts a cross-sectional view, taken along line 55 of FIG. 1, of a channel in accordance with embodiments of the present invention.

The slab 10 further includes a plurality, in this example three, channels 18 running longitudinally along the length L of the slab 10. The channels 18 formed within the bottom surface 13 of the slab 10 facilitate the even dispersement of a bedding material, such as bedding grout or concrete, a polymer foam material, or other similar material, to the underside of the slab 10. As shown in FIG. 5, which depicts a cross-sectional view of the slab 10 (along line 5—5 of FIG. 1), each channel 18 includes a port 20 at each end of the channel 18 (one end shown in FIG. 5). Each port 20 extends from the top surface 9 of the slab 10 to the channel 18, thereby providing access to the channel 18 from the top surface 9 of the slab 10. This facilitates the injection of bedding material beneath the bottom surface 13 of the slab 10 via ports 20 which are accessible from the top surface 9 after the slab 10 has been installed.

Figure 6:
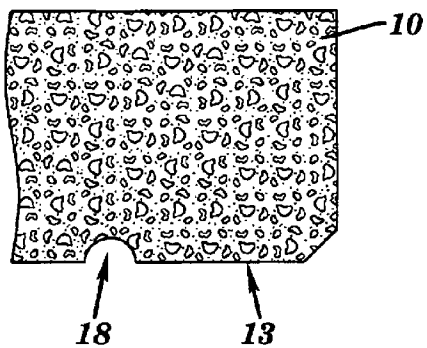
FIG. 6 depicts a cross-sectional view, taken along line 6—6 of FIG. 1, of the channel in accordance with embodiments of the present invention.

As illustrated in FIG. 6, which shows a cross-sectional view of the channels 18 along a line 6—6 of FIG. 1, the channels 18 are in the shape of half round voids. The rounded shape aids in the uniform distribution of bedding material along the bottom surface 13 of the slab 10 to fill any gaps between the slab 10 and the subbase (not shown). In the alternative, the channels 18 may take other shapes, such as rectangles, etc. Furthermore, instead of using channels 18 to facilitate the even dispersement of the bedding material beneath the slab 10, a pipe system may be used. For instance, the pipe system (not shown) may comprise a plurality of pipes, approximately one inch in diameter, having holes or continuous slots formed therein.

Figure 7:
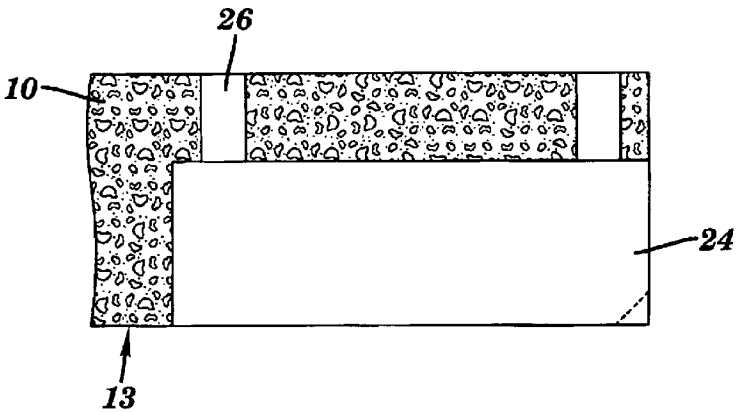
FIG. 7 depicts a cross-sectional view, taken along line E—E of FIG. 1, of a connector slot in accordance with the embodiments of the present invention.

The slab 10 further includes a plurality of interconnection slots 24, shown in this example within a first side 11*a* of the slab 10 (FIG. 1). The slots are illustrated more clearly in FIGS. 7 and 8A–8C. In particular, FIG. 7 shows a cross-sectional view of an interconnection slot 24 taken along a line 7—7 of FIG. 1. As illustrated, each interconnection slot 24 comprises a pair of openings, accesses or ports 26 at each end of the slot 24 which extend from the top surface 9 of the slab 10 to the interconnection slot 24 thereunder.

Figure 13A:
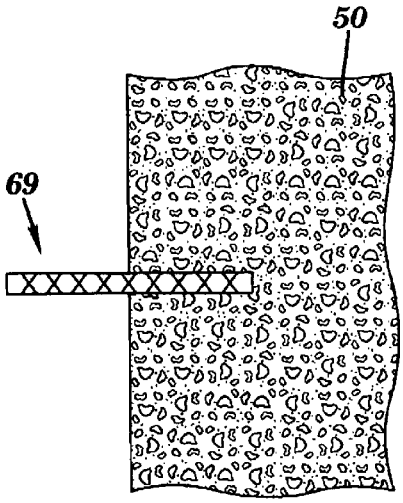
FIG. 13A depicts a cross-sectional view of a dowel and an existing slab in accordance with embodiments of the present invention.
Figure 13B:
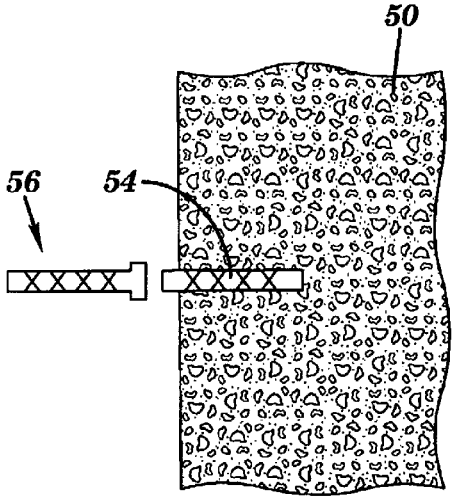
FIG. 13B depicts a cross-sectional view of a two-piece connector and an existing slab in accordance with embodiments of the present invention.

The slab 10 further includes a plurality of connectors 69 that may comprise longitudinal connectors, non-slippable connecting rods or dowels embedded within a second side 11*b* of slab 10 along the length L of the slab 10. As with the connectors 12, the connectors 69 may be post tensioned interconnections. The connectors 69 may be one-piece, where approximately half of the connector 69 is embedded within the pavement slab 10 and half of the connector 69 extends from the second side 11*b* of the slab 10. Alternatively, the connector 69 may be of a two-piece design comprising a first connector 54 and a second connector 56 as shown in FIG. 13B. The two-piece design would be used if it is desirable to keep shipping width of slab 10 to a minimum.

Figure 8A:
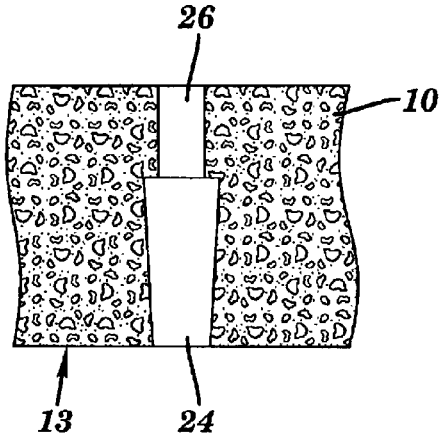
FIG. 8A depicts a cross-sectional view, taken along line 8—8 of FIG. 1, of a connector slot in accordance with embodiments of the present invention.
Figure 8B:
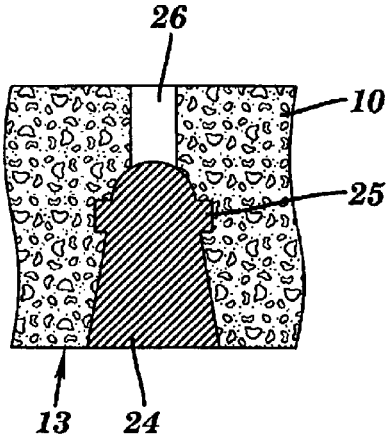
FIG. 8B depicts FIG. 8A using an alternative connector slot in accordance with embodiments of the present invention.
Figure 8C:
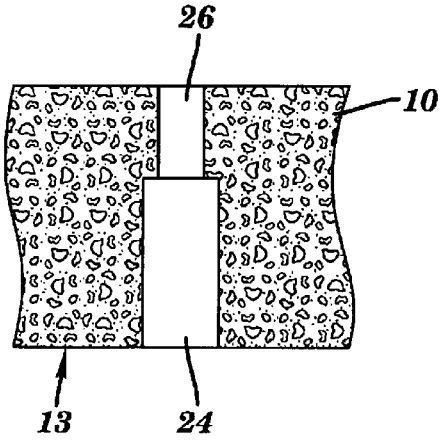
FIG. 8C depicts FIG. 8A using an alternative connector slot in accordance with embodiments of the present invention.

FIG. 8A depicts a cross-sectional view of the interconnection slot 24 and port 26 along line 8—8 of FIG. 1. Similar to the interconnection slots 14 along the sides 11*c*, 11*d* of the slab 10 (shown in FIGS. 4A–4C), the interconnection slots 24 along the sides 11*a*, 11*b* of the slab 10 may alternatively take the form of a mouse hole 24 having cut-outs or holes 25 (FIG. 8B), or a slot 24 having vertically oriented sandblasted sides (FIG. 8C). The interconnection slots 24 receive connectors 69 that may comprise non-slippable connecting rods or dowels located within and extending from an adjacent new slab 10 or from an existing slab 50, such has been described embedded in the second (i.e., other) side 11*b* of slab 10.

After the slab has been installed and the connectors are in their final location, a binder material, such as structural cement-based grout, a polymer foam, etc., is then injected into the interconnection slots 24, having the rods inserted therein, from the top surface 9 of the slab 10 via the ports 26. This aids in rigidly interconnecting adjacent slabs of the roadway and facilitates a relatively even load transfer between lanes.

Figure 9:
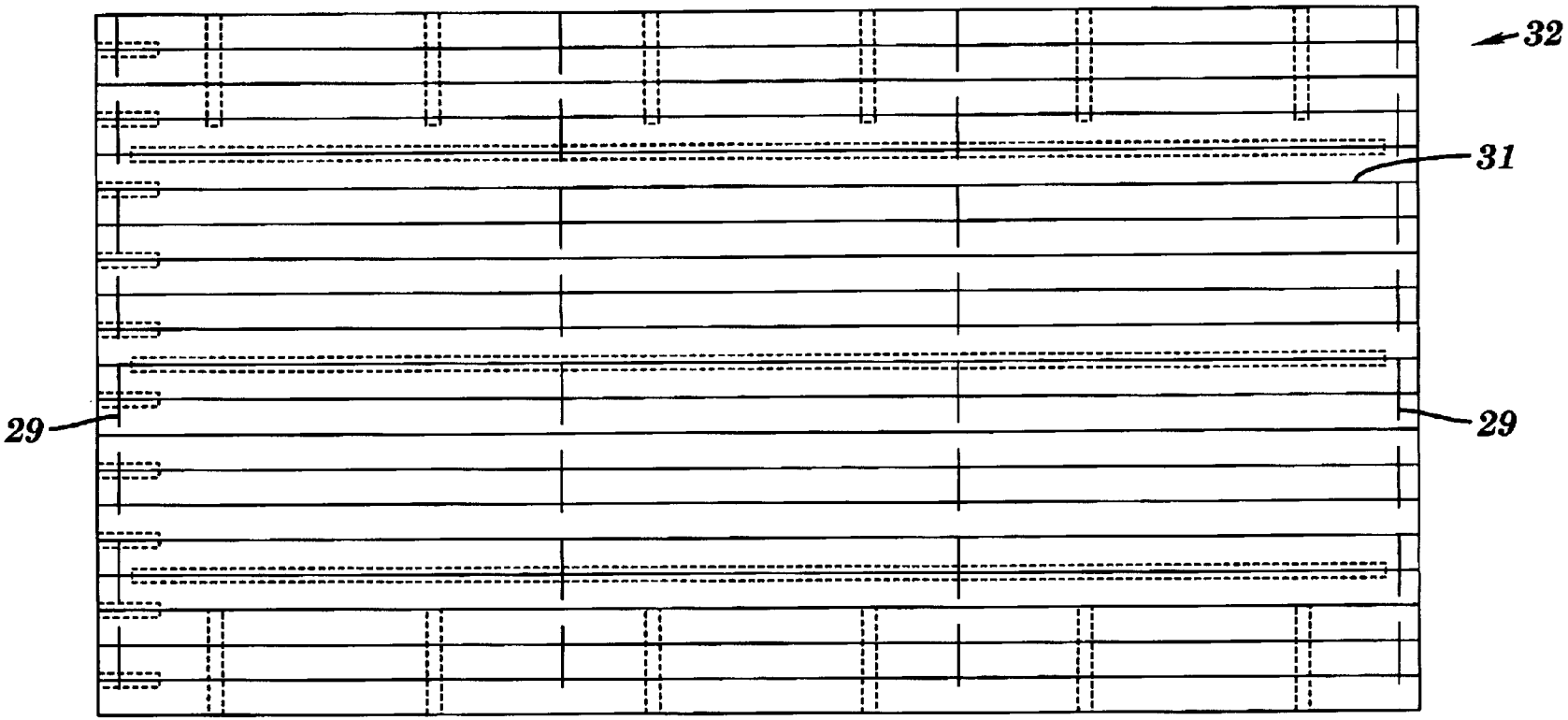
FIG. 9 depicts a top mat in accordance with the present invention.
Figure 10:
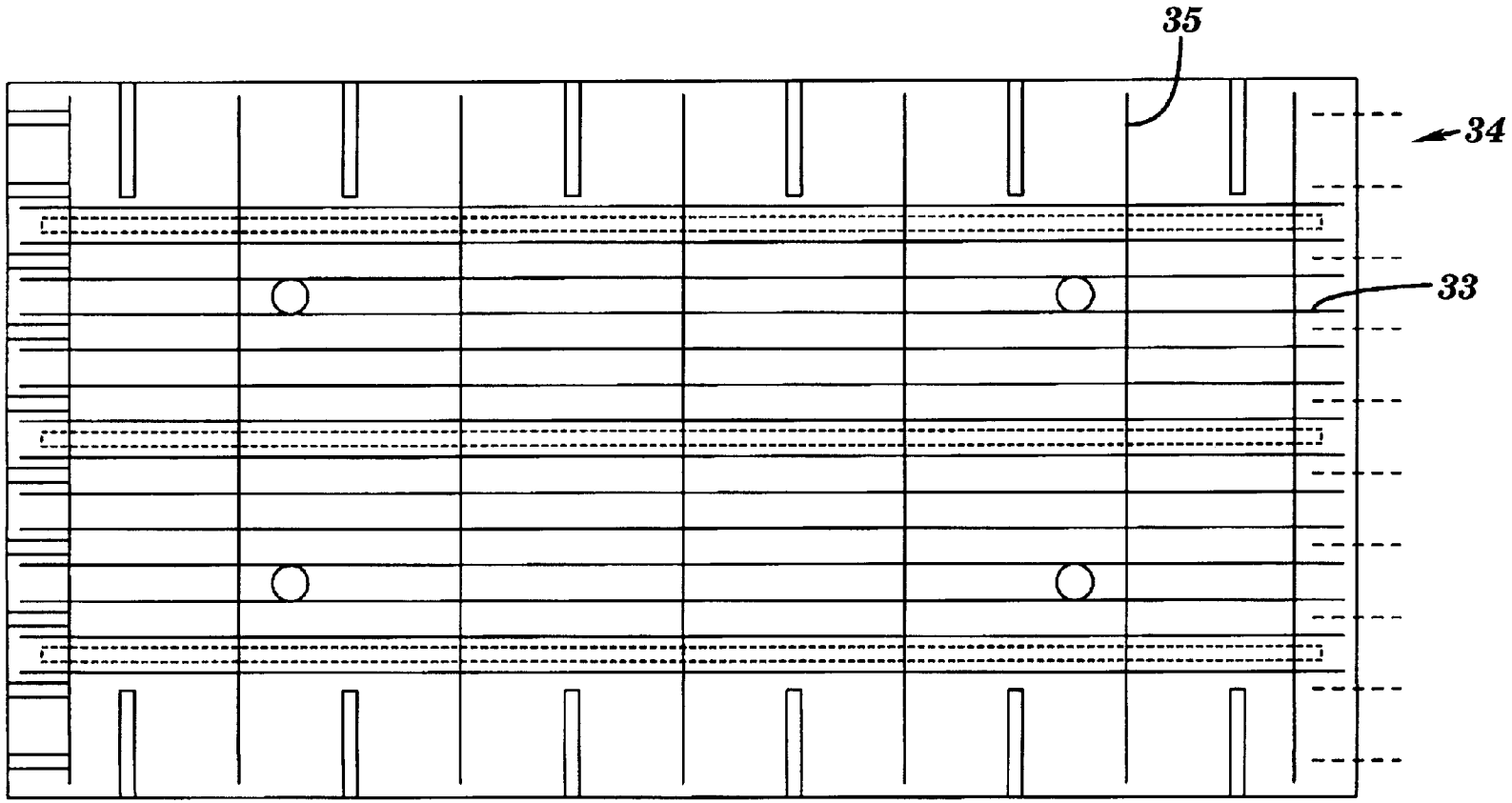
FIG. 10 depicts a bottom mat in accordance with the present invention.

The slab 10 further includes a top mat 32 and a bottom mat 34 (FIGS. 9 and 10, respectively). Both mats 32, 34 comprise reinforcing bars, or in the alternative reinforced steel mesh. The top mat 32, comprising longitudinal bars 31 and at least two transverse or cross bars 29, is formed within the slab 10 substantially near the top surface 9 of the slab 10. The top mat 32 aids in minimizing the slab 10 from "curling" or bending at the edges as a result of cyclic loading produced by temperature differentials. Likewise, the bottom mat 34 comprises longitudinal bars 33 and transverse or cross bars 35 formed within the slab 10 substantially near the bottom surface 13 of the slab 10. The bottom mat 34 provides the slab 10 with additional reinforcement and stability during handling.

Figure 11:
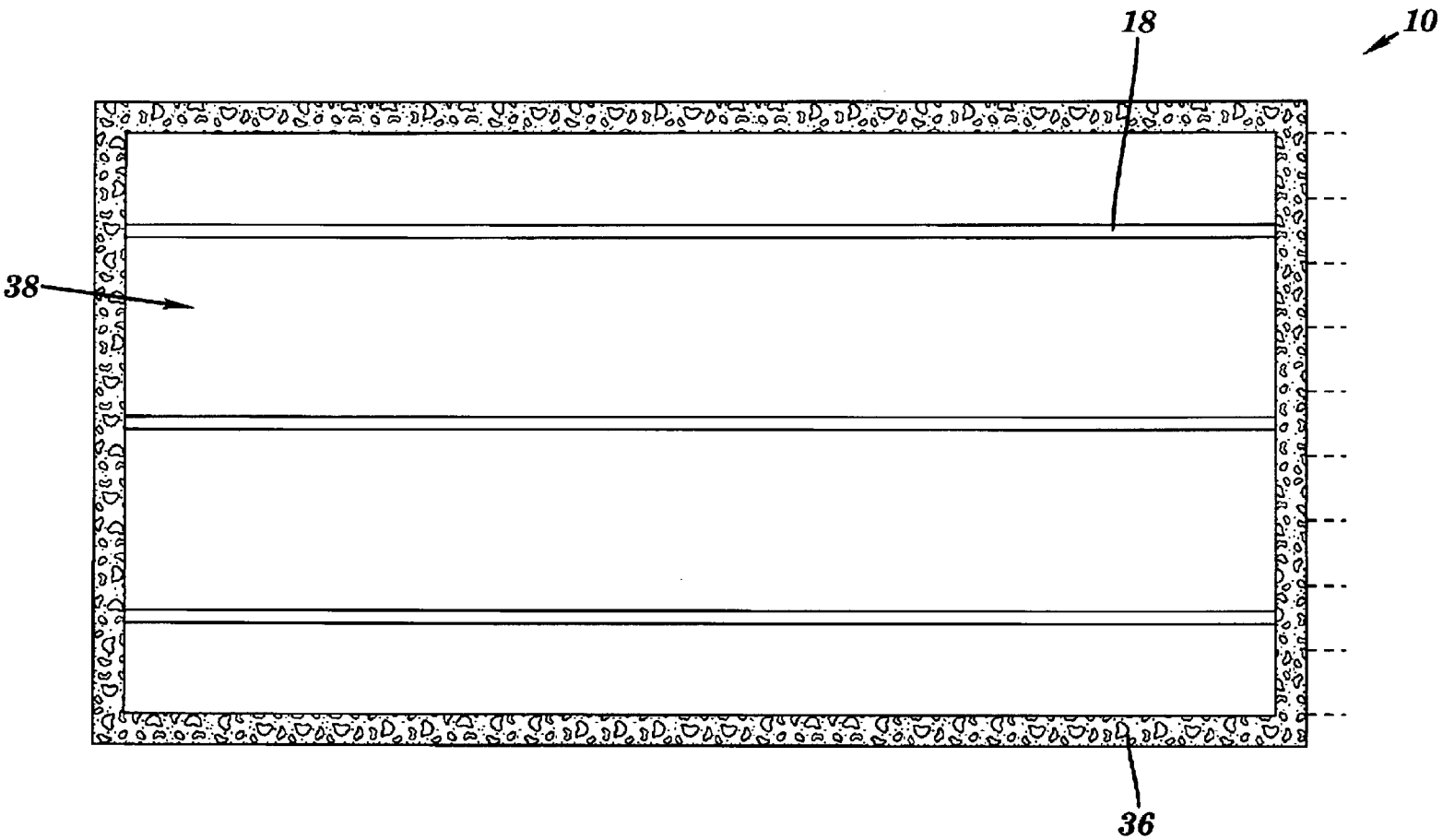
FIG. 11 depicts a gasket in accordance with the present invention.

A seal or gasket 36, comprising a compressible closed cell foam material, such as neoprene foam rubber or other similar material, is attached to the bottom surface 13 of the slab 10 around the perimeter of the slab 10, as illustrated in FIG. 11. In one embodiment, the gasket 36 is approximately 18 mm thick and 25 mm wide, and is soft enough to fully compress under the weight of the slab 10. The gasket 36 forms a chamber or cavity 38 thereby sealing the boundary of the slab 10. This allows for the application of pressure to the bedding material during installation to ensure that all voids between the bottom surface 13 of the slab 10 and the subbase are filled.

In another embodiment, the gasket 36 can be made from a material selected of such a softness so that the slab 10 is held up a predetermined amount so as to create a design space for grout or other bedding material to be inserted. The softness of the selected material for the gasket 36 in this embodiment will conform so that the top surface 9 and bottom surface 13 of the slab 10 is held generally parallel to the surface of the prepared subgrade. This embodiment is useful when the subgrade, rather than compacted stone dust, is a dense graded base, as discussed below.

Figure 12:
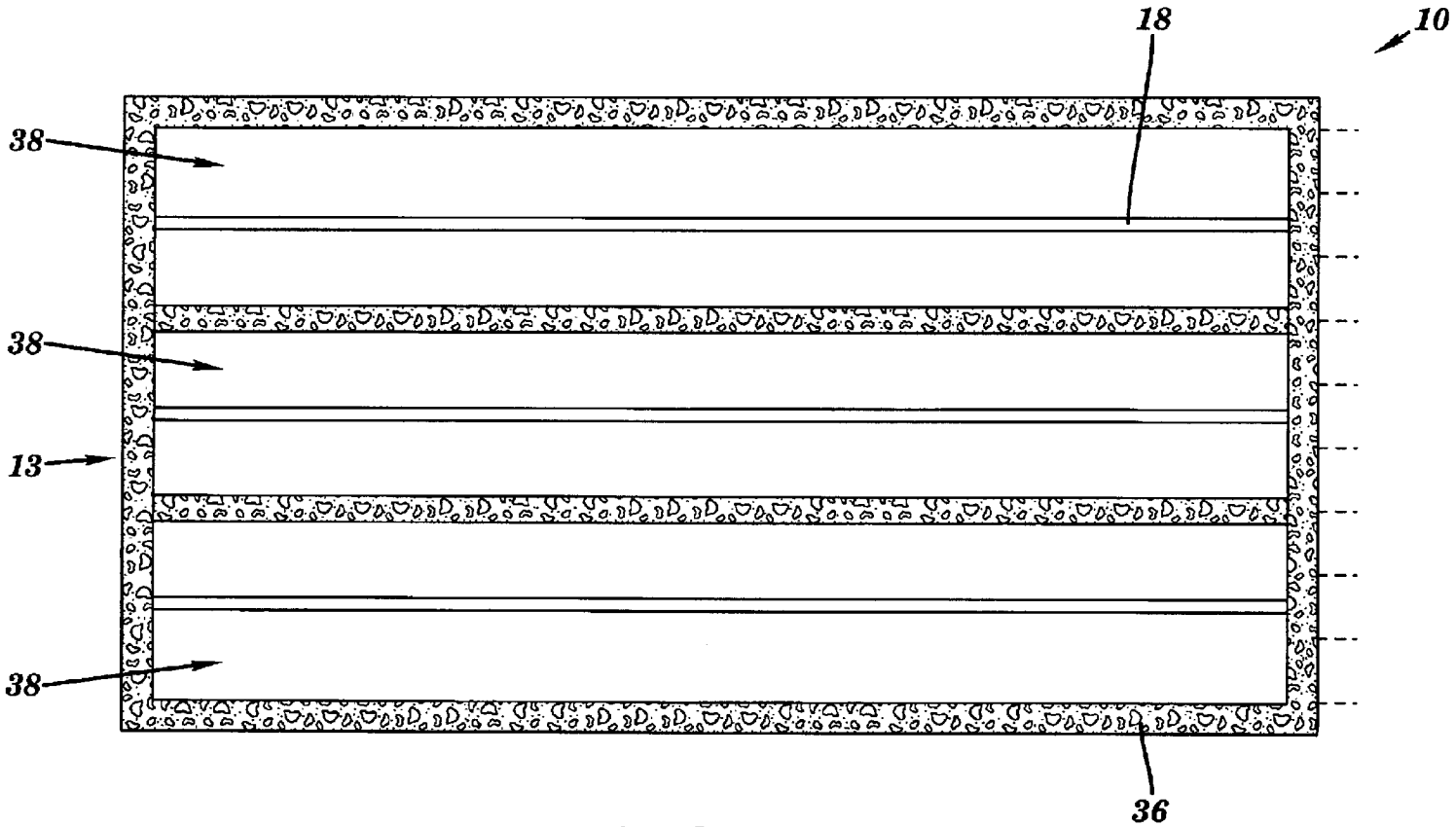
FIG. 12 depicts FIG. 11 using additional sections of a gasket in accordance with embodiments of the present invention.

Optionally, additional sections of the gasket 36, having the same or similar width and thickness, may be applied to the bottom surface 13 of the slab 10 to form a plurality of individual chambers or cavities 38, as illustrated in FIG. 12. The additional sections of the gasket 36 forming the cavities 38 reduce the amount of upward pressure exerted on the slab 10 during the injection of the bedding material as compared to that experienced by the slab 10 using one large sealed cavity (as illustrated in FIG. 11). Forming at least 3 to 4 cavities 38 effectively reduces the lift force produced from below the slab 10 as the bedding material is being forced thereunder.

In an alternative embodiment (not shown) of the present invention, a different binder distribution system is employed. In lieu of gasket material 36, a geotech fabric, or the like, is used to hold the binder material. For example, two layers of a geotech fabric is attached to the slab 10 in various locations. The layers of geotech fabric may be additionally attached to each other in selective locations thereby forming pockets between the fabric layers which receive the pumped in grout. In addition, the bottom surface 13 of the slab 10 may be flat. The geotech fabric thus acts as a series of chambers to hold and distribute the grout, or similar binder material. In another embodiment, a single layer of geotech fabric is attached to the slab 10. Thus, the grout, or binder material, is pumped between the geotech fabric and the bottom surface 13 of the slab 10.

To install the slab 10, connectors 12 may first need to be installed along the transverse end of the existing slab 50, and connectors 69 may need to be installed along the longitudinal side of the existing slabs 50, to match interconnection slots 14 and 24, respectively. If so, a hole may be drilled within the existing slab 50, using carbide tipped drill bits, or other similar tools. Thereafter, the connector 12 or the connector 69 is inserted within each hole, along with a binder material, such as a cement-based or epoxy grout, polymer foam, etc., such that approximately one half of the connector 12 or the connector 69 extends therefrom, as illustrated in FIGS. 3 and 13A, respectively. Slab 10 and existing slab 50 may be the same structurally and both slab 10 and existing slab 50 may have interconnect slots and/or connectors.

Figure 13C:
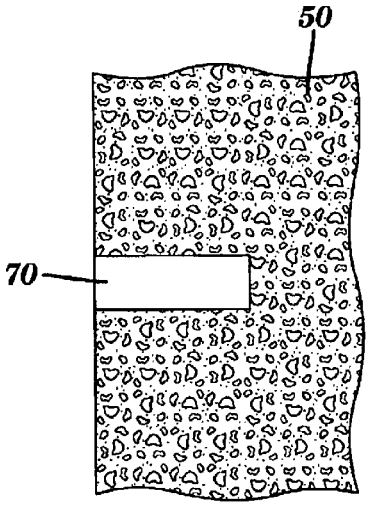
FIG. 13C depicts a plan view of a slot cut in an existing slab in accordance with the present invention.
Figure 13D:
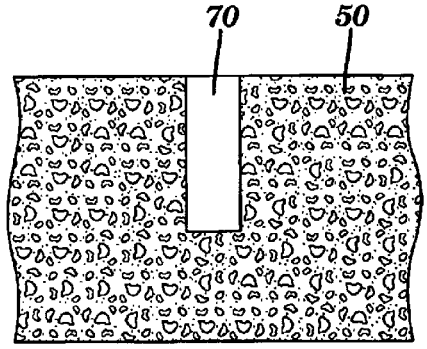
FIG. 13D depicts a cross-sectional view of a slot cut in an existing slab in accordance with the present invention.

Alternatively to installing connectors 12 and connectors 69 in the existing slab to mate with the interconnection slots 14 and 24 in the slab 10, the same connectors 12 and connectors 69 may be embedded in the slab 10 such that they extend from the slab 10 as described above. In this case, a vertical slot 70 is cut in the existing slabs 50 using a diamond blade concrete saw, or other similar tool, in locations corresponding to the extended connectors 12 and connectors 69 in slab 10 (refer to FIGS. 13C and 13D). The sawing operation would be done ahead of the slab 10 installation operation. The slots 70 would be opened up and burrs removed using a light-weight pneumatic chipping hammer, or other similar tool. This option would be chosen to avoid the above described drilling process that should be done during the night-time grading operation.

In preparation for slab installation, the replacement area (the area in which the slab 10 will be placed) is cleaned of all excess material to provide a subbase or sub-grade approximately 25 mm below the theoretical bottom surface 13 of the slab 10. The subbase is graded with conventional grading equipment such as a grader, backhoe, skid steer loader, etc., and fully compacted with a vibratory roller or other similar device. The compacted subgrade is subsequently overlaid with approximately 30 mm of finely graded material such a stone dust that can be easily graded with the precision grading equipment described below.

Figure 14:
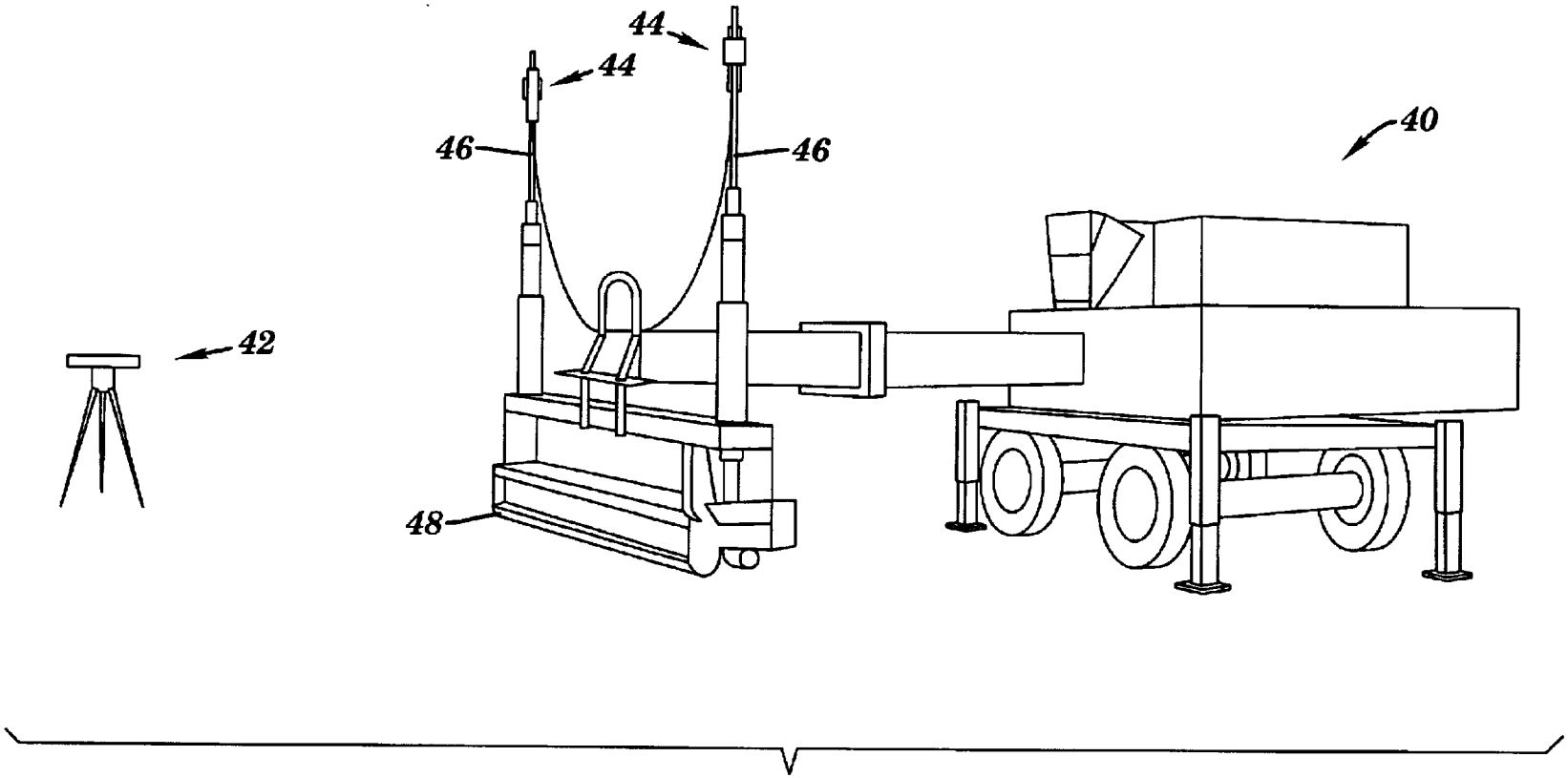
FIG. 14 depicts a grading device used in accordance with the present invention.

The stone dust is then graded with a grading device, such as the Somero Super Grader™ (Somero Enterprises of Jafrey, N.H.), as illustrated in FIG. 14. The Somero Super Grader™ is controlled by a rotating laser beam, or 3-D total station, that is continuously emitted by a laser transmitter 42, located at a remote location and at least 6–8 feet above ground level. The transmitter is adjusted to emit a beam of unique cross-slope and grade corresponding to the plane required for the slab 10. The cross-slope allows for water run-off and the grade represents the longitudinal slope required for vertical alignment of the roadway.

For straight highways, where the cross-slope and the grade are constant, the rotating laser beam set as described above will serve to set multiple slabs. For both horizontally and vertically curved highways the rotating laser beam will have to be set to a distinct plane for each slab. This continuous adjustment may be done manually or automatically with software designed for that specific purpose. Alternatively, the screed may by controlled by other electronic means unique to the Somero Super Grader™.

Specific to the Somero Super Grader™, laser receivers 44, mounted on posts 46 above the screed 48, receive and follow the theoretical plane emitted from the transmitter 42 as the grading screed 48 is pulled over the replacement area leaving the stone dust approximately ¾" high. After the first grading pass, the stone dust layer is damped with water and fully compacted with a vibratory roller or other similar device and a second, and final, grading ("shaving") pass is made in which the subbase is brought to within $1/16^{th}$ of an inch (or "Super-Graded□") of the required theoretical plane. The stone dust layer is dampened with water, as needed for the subsequent grouting process, in final preparation for installation of the slab 10.

In an alternative embodiment, the layer of finely grade material such as stone dust is omitted. In lieu of the stone dust, a dense graded base is placed in two lifts. The first lift is placed about 1" lower than theoretical elevation. It is then wetted and rolled such that its final average elevation is slightly lower than the required final elevation of the bottom surface 13 of the slab 10. The second lift is super graded in a similar fashion to an elevation slightly higher (e.g., ¼") than theoretical elevation and wetted and rolled as required in final preparation for installation of the slab 10. The second lift of dense graded base typically cannot be supergraded ("shaved") after is has been wetted and rolled because unlike the stone dust the dense graded base has variable size and larger stone that would get pulled up from the subgrade.

Thus, when dense graded base is used as a subbase material, the finished surface is more apt to be slightly rougher in that there will exist larger stone that sticks up above the surface of the rest of the field of dense graded base. It is because of these projecting stones, that the embodiment for the gasket 36 material discussed above that is not fully compressible is used. The non-fully compressible gasket 36 is able to mold around and conform to the projecting stones in the final graded dense graded base without changing the final average elevation of the placed slab 10.

The slab 10 is placed within the replacement area such that the slab 10 contacts the subbase uniformly so as not to disrupt the subbase or damage the slab 10. During placement, the slab 10 is lowered vertically to the exact location required to match the adjacent existing slabs 50. Care is taken to insure the interconnection slots 14 and 24, within the sides and end (if an adjacent slab is present at the end of the slab 10) of the slab 10 are lowered over the connectors 12 and connectors 69 extending from the ends and sides of the adjacent slabs 50 respectively. In the case where connectors 12 and connectors 69 extend from the slab 10, the slab 10 is also lowered vertically and carefully to insure the connectors 12 and connectors 69 are set within the slots 70 of the adjacent existing slabs 50. At this time, the slab 10 should be within 6+/− mm of the theoretical plane emitted from the rotating laser transmitter 42. In the event the surface 9 of the slab 10 is out of the required tolerance it is planed with a conventional diamond grinder until it is brought within tolerance.

The interconnection slots 14, 24 or 70, as the case may be are filled from the top surface 9 of the slab 10 with a binder material such as structural grout, or in the alternative, a polymer foam material, thereby fastening the slab 10 to the connectors 12, 54, 56, 69 or the slot 70 of the adjacent existing slabs 50. In particular, the binder material is injected under pressure into a first port 16, 26 of the interconnection slots 14, 24, respectively, until the binder material begins to exit the port 16, 26 at the other end of the interconnection slot 14, 24. It is desirable for the binder material within the slots 14, 24 to reach sufficient strength to transfer load from one slab to the other before opening the slab 10 to traffic.

The chamber(s) 38 formed by the gasket 36 on the bottom surface 13 of the slab 10 is/are then injected from the top surface 9 of the slab 10 with bedding material, such as grout including cement, water and fly ash, or in the alternative with a polymer foam material. In particular, starting from the lowest or downhill region, bedding material is injected into the port 20 at one end of the channel 18 until the bedding material begins to exit the port 20 at the other end of the channel 18. The bedding material is injected into the channels 18 to ensure that all voids existing between the bottom surface 13 of the slab 10 and the subbase, regardless of size, are filled. The slab 10 should be monitored during injection of the bedding material to ensure the slab 10 is not vertically displaced due to the upward pressure created thereunder. It is desirable for the bedding material under the slab 10 to reach a minimum strength of approximately 10.3 MPa before opening the slab 10 to traffic.

It should be noted that due to the precision of the Super Graded subbase, the channels 18 may not need to be filled prior to exposure of the slab 10 to traffic. Rather, the channels 18 may be filled within 24–48 hours following installation of the slab 10 without damaging the slab 10 or the subbase. In other words, if required, vehicular traffic can be allowed on the slabs 10 immediately after the placement of the slabs 10. This is particularly useful due to time constraints.

A warped slab is defined as a slab that has a warped surface. A slab being a body of uniform thickness in which the sides are substantially perpendicular to both the top and bottom surfaces. A warped surface being a surface in which all the points of the surface are not in a single plane. That is, the slab is not entirely planar, but warped. For example, with a rectangular-shaped warped slab, three of the four corners of the slab could be in a single plane. The fourth corner conversely would not reside in this same single plane. This fourth corner would be either "higher" or "lower" in relationship to the plane in which the other three corners reside. With the warped slab, typically both the top and bottom surfaces are parallel and warped. Thus, the warped slab's top and bottom surfaces will both match and be substantially parallel to the surface of the subgrade on which the warped slab is placed. A warped slab is further defined wherein all the edges are straight, wherein an edge is the intersecting line between any side and either the top or bottom surface of the slab. Further, with a warped slab, when any cross section is taken that is perpendicular to a longitudinal side, the resultant edges (i.e., the lines at the top and bottom surface of the cross-sectional "cut") will likewise be straight lines. Conversely, if a diagonal (i.e., non-perpendicular) cross section is taken of the warped slab, the resultant edges (i.e., the lines at the top and bottom surface of the cross-sectional "cut") will not be straight, but non-linear.

The use of a warped slab in roadway construction is typically called for when the cross-sectional slope of a road lane changes over the longitudinal length of the roadway slab. Similarly, a warped slab in roadway construction could also be used when the roadway lane is both curved over the longitudinal length of the roadway slab and has a change in elevation over the longitudinal length (i.e., profile change) of the roadway slab. Prefabricated warped pavement slabs could be used, for example, both over subgrade in a roadway as well as in an elevated condition such as bridge, viaduct, or parking garage construction.

The present invention is able to make precision prefabricated warped pavement slabs with precision tolerances throughout the whole plan area of the slab. The device is able to thus make prefabricated pavement slabs either in a flat slab configuration or a warped slab having a total warp in the range from 3–4 mm to approximately 3 inches. Although the shape, in plan, of the warped slab can be rectangular, other non-rectangular shapes are readily attainable with the present invention. Another advantage of the present invention is the ability to construct a pre-fabricated warped pavement slab wherein the warp in the slab matches precisely and uniformly throughout the whole area of the slab a predetermined warp required for the specific roadway section being built, as well as, precisely matching the warp of the entire subgrade in the location where the slab will be placed. Another advantage of the present invention is the ability to quickly install prefabricated pavement slabs in their final location and to allow vehicular traffic use the installed pavement shortly after the installation.

Figure 16:
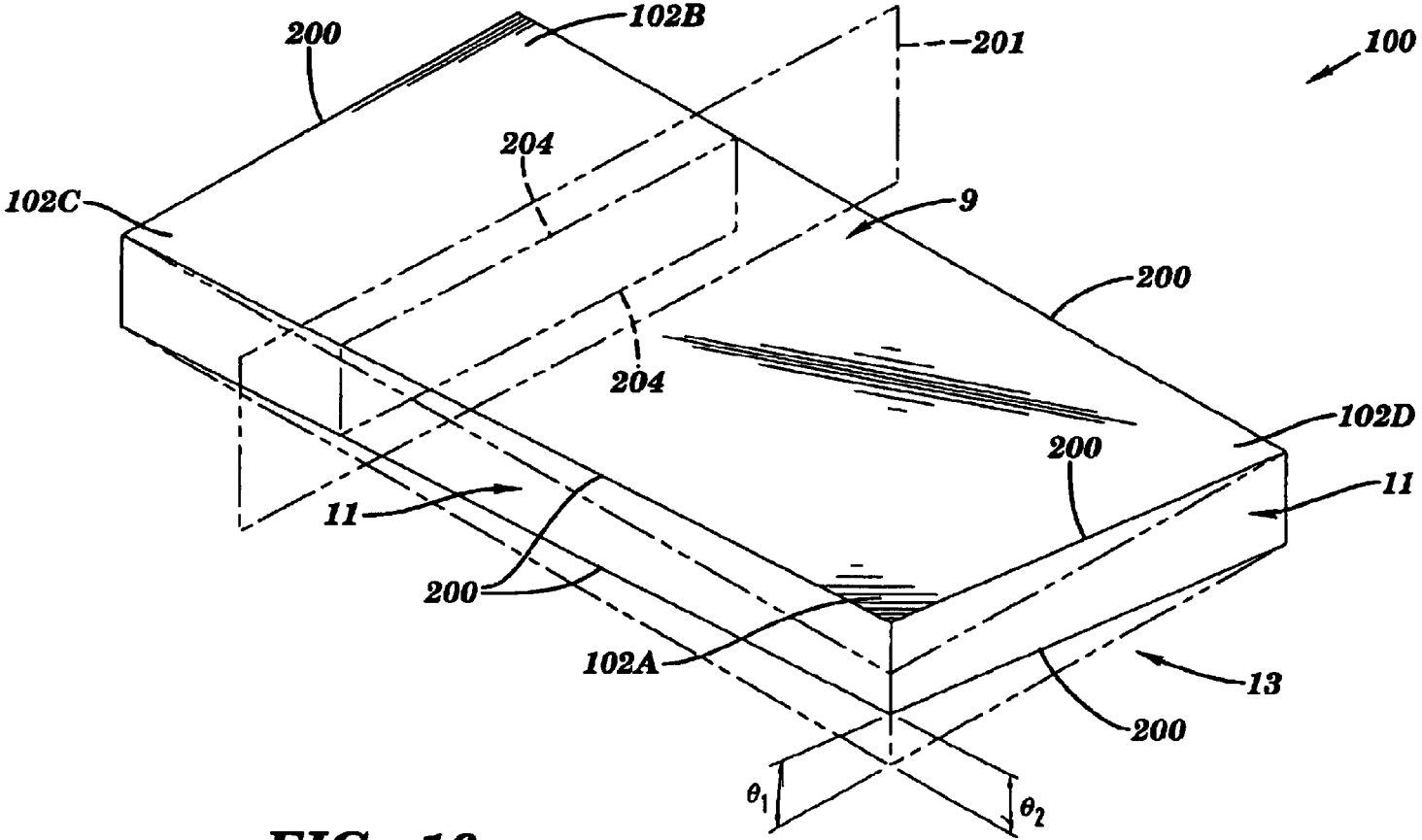
FIG. 16 depicts a perspective view of a warped slab in accordance with the present invention.

FIG. 16 shows a perspective view of a pre-fabricated warped pavement slab, designated as 100. The top 9 of the warped slab 100 is shown as are some of the sides 11. A rectangular pre-fabricated warped pavement slab 100 is shown. However, pre-fabricated warped pavement slabs 100 can be made with different footprint shapes (i.e., non-rectangular). The pre-fabricated rectangular warped pavement slab 100 has four corners 102 (i.e., 102A, 102B, 102C, 102D). The first corner 102A, or non-planar corner, is shown lifted above the planar surface of the other three corners 102B, 102C, 102D. Thus, the first corner 102A is out of plane with the other three corners 102B, 102C, 102D. The ton surface 9 has shading to assist in showing the warped top surface 9. A flat slab with all four corners 102 in the same plane is shown in phantom. Although in FIG. 16 the first corner 102A is shown above the other three corners 102B, 102C, 102D, the first corner 102A could conversely be lower than the other three corners 102B, 102C, 102D. Similarly, the non-planar corner could be any one of the other three corners of the pre-fabricated warped pavement slab 100 instead of just the first corner 102A, since any three corner define a plane. The amount that the first corner 102A is out of plane with the other three corners 102B, 102C, 102D is further shown by the angles $\theta_1$ and $\theta_2$, which connote the angles between the warped surfaces 9, 13 and the plane that the other three corners 102B, 102C, 102D share.

Figure 17A:
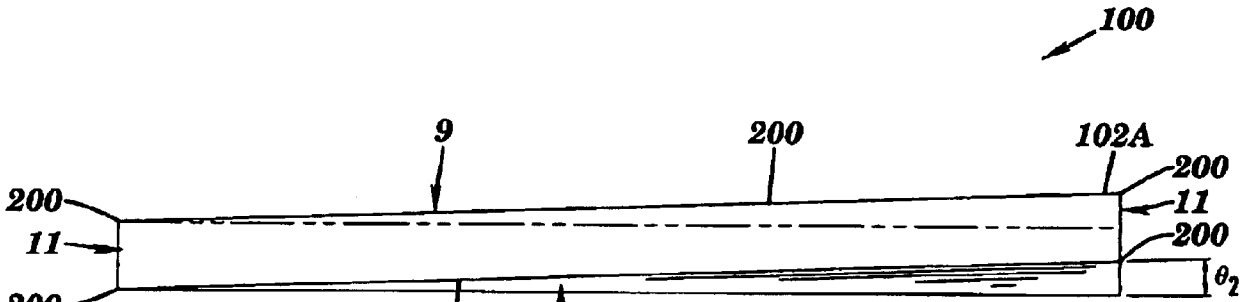
FIG. 17A depicts a side view of a side of a warped slab in accordance with the present invention.
Figure 17B:
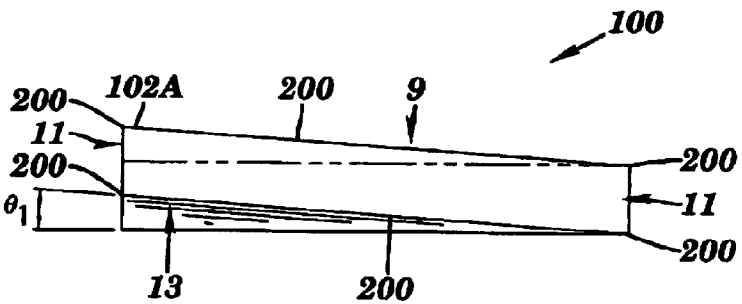
FIG. 17B depicts a side view of an end of a warped slab in accordance with the present invention.

FIGS. 17A and 17B show side views of a pre-fabricated warped pavement slab 100. The non-planar corner 102A is shown higher than the rest of the warped slab 100. The bottom surface 13 of the slab 100 that is showing in FIGS. 17A and 17B is shaded to aid in clarifying the warped top surface 9 and bottom surface 13. The top and bottom edges 200 (i.e. intersecting line between sides 11 and top surface 9 and bottom surface 13) of all the sides 11 of the pre-fabricated warped pavement slab 100 are straight. Similarly, if a cross-section "cut" was taken of the warped slab 100 at any location along the warped pavement slab 100, wherein the cross-section "cut" is taken perpendicular to a side 11, the resultant edges will similarly be straight. An example of a cross sectional "cut" is shown in FIG. 16, wherein the "cut" is denoted 201 and the resultant edges are marked 204.

In order to create a pre-fabricated warped pavement slab 100 a portion of the formwork must be placed out of the plane of the remaining planar portion of the formwork. This is done by lifting, or lowering, the corner, or area of the formwork which must be moved out of plane from the remaining planar portion of the formwork. The formwork for making the pre-fabricated warped pavement slabs 100 have an advantage of being at a remote location. That is the formwork can be adjacent, or on the applicable construction project, or at a remote location wherein additional quality controls and assurances can more readily take place.

Figure 18:
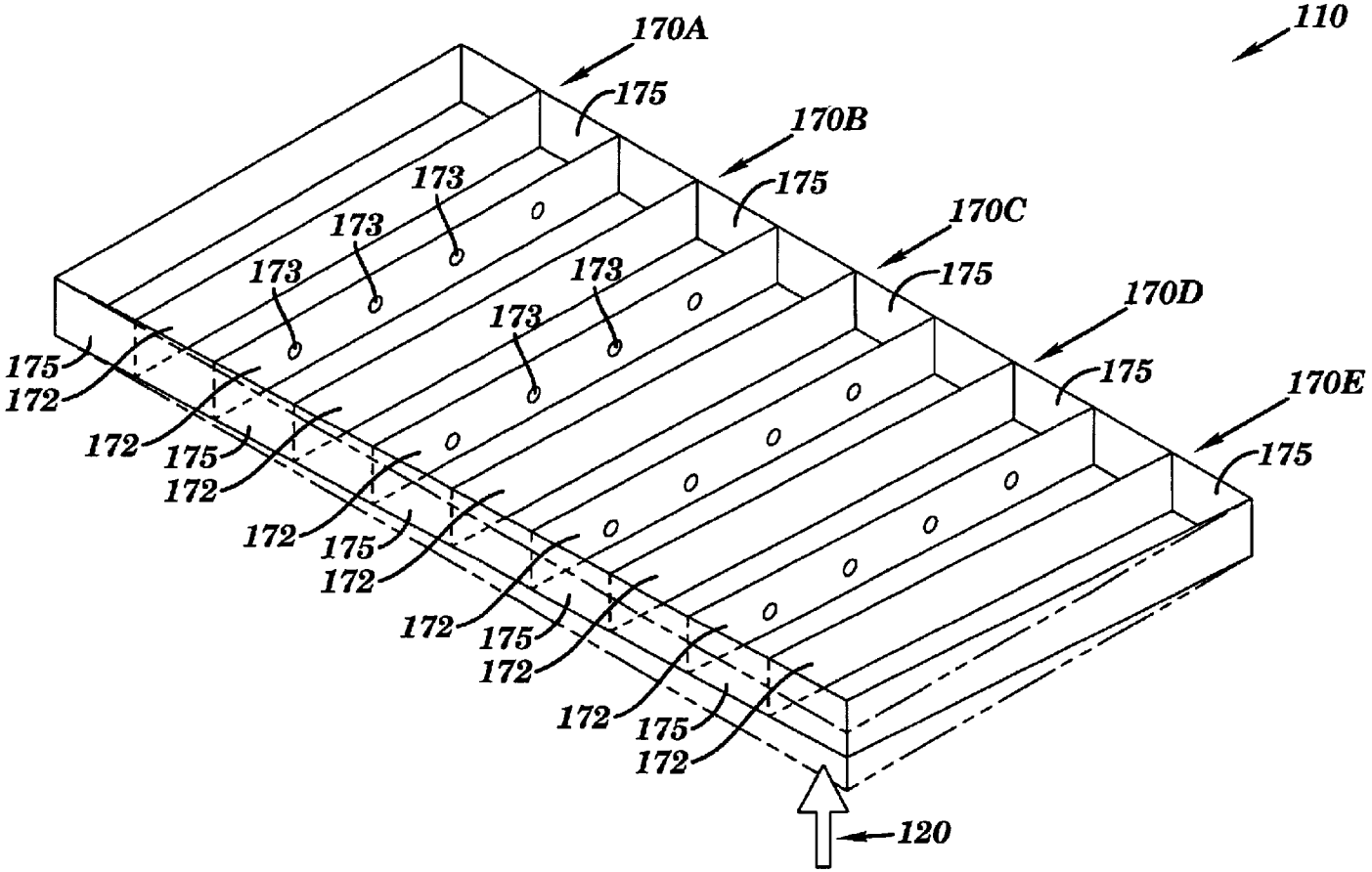
FIG. 18 depicts a perspective view of a portion of a forming system in accordance with the present invention.

FIG. 18 depicts a perspective view of a portion of a pre-fabricated warped pavement form system 110. In this embodiment, there are five individual form sections 170 (e.g., 170A, 170B, 170C, 170D, 170E) each made up, in part, of three vertical stiffeners 172 spaced uniformly extending the length of the form sections 170. The stiffeners 172 of adjacent form sections 170 are mated together and attached to each other via a series of four bolts 173 spaced evenly along the stiffeners 172. At either end of the form section 170 are end caps 175. A device for adjusting 120 is shown adjusting one corner of the form system 110 out of plane with the other three corners, thus creating a warped form system 110. The form system 110, now warped, will then be able to construct a pre-fabricated warped pavement slab 100. The warp-adjusting device 120 can either lift, or lower, the form system 110 out of plane with the other three corners. Although this embodiment depicts a form system 110 with five form sections 170, any quantity of form sections 170 can be employed such that adequate flexure is accomplished throughout the form system 110 upon the placement of the adjusting device 120 to the form system 110. Similarly, although four bolts per mated stiffener 172 is depicted, any quantity of connection means and any type of connection means can be employed to effectively connect the plurality of form sections 170 together.

Figure 19:
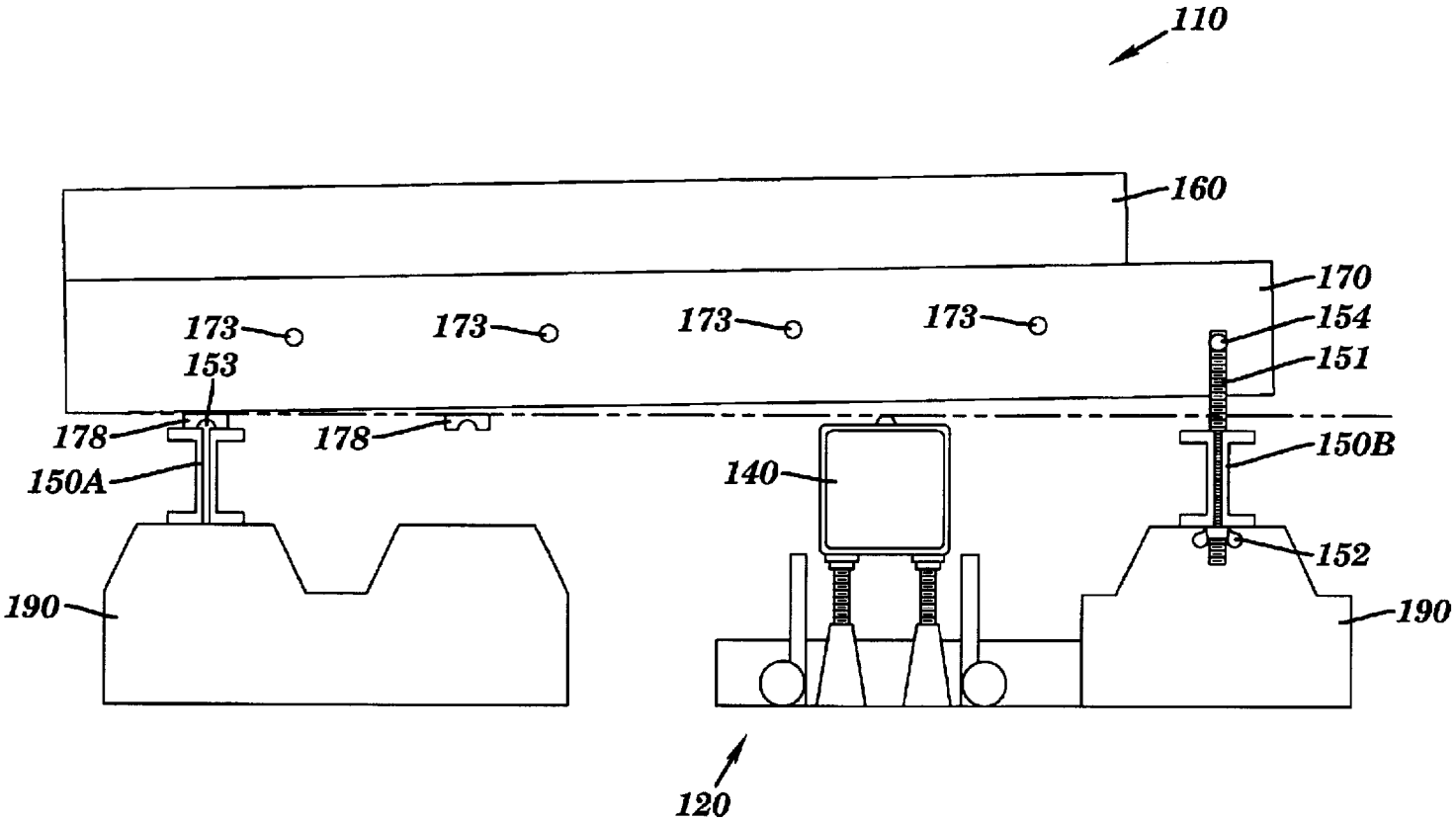
FIG. 19 depicts a side sectional view of a portion of a forming system in accordance with the present invention.

Beneath the plurality of form sections 170 is equipment which, in part, comprise the device for adjusting 120 the warp of the form system 110. FIG. 19 shows a sectional side view of a portion of the form system. A device for adjusting a warp of the form system, such as the mobile jacking trolley 120 is shown which lifts a jacking beam 140 which in turn lifts the plurality of form sections 170. On top of the form sections 170 are a plurality of side rails 160, between which the hardenable, flexible material (e.g., concrete) is placed. Underneath the form sections 170 are two support beams 150, a first support beam 150A, and a second support beam 150B. The support beams 150 rest on a plurality of concrete bases 190. On top of the first support beam 150A is a half round 153 which mates with one, of two, pivot plates 178. The first support beam 150A is moveable and thus, depending on the width of the warped slab 100 desired, can be moved to various locations on the concrete base 190. The half round 153, depending on the location of the first support beam 150A, engages with one of the pivot plates 178. The other end of the form sections 170 rest on a second support beam 150B. The second support beam 150B, similarly, rests on a concrete base 190. In an embodiment, the second support beam 150B is located at a lower elevation (e.g., approximately 2–3 inches) than the first support beam 150A. The second support beam 150B serves as a support for the form sections and side rails 160 while the jacking beam 140 is being rolled into position. The side rails 160 are moved into a desired configuration of the shape of the desired warped slab 100. Then the jacking beam 140 is moved into place via the jacking trolleys 120 so that it is underneath and aligns with the edge of the desired warped slab 100 which will receive the warp adjustment. Thus, the jacking beam 140 will be underneath and aligned under one of the side rails 160 where in the warping will take place. The jacking beam 140 is lifted to the desired elevation such that the form sections 170 and side rails 160 are out of level (level is shown in phantom). Once the form sections 170 and side rails 160 are moved to the correct elevation, the threaded rod 151, clevis 154, and wing nut 152 combination located at the second support beam 150B are tightened thereby lashing down the warped end of the form sections 170 to insure they conform to the straight-line definition at the jacking beam 140 and to prevent any unwanted uplift on the form sections 170 and the second support beam 150B. In other words, the threaded rod 151, clevis 154 and wing nut 152 combination keep, in part, the form system 110 at the predetermined, exact amount of warp. The form sections 170 can be either raised or lowered out of level, thus creating the desired warped condition.

Figure 20:
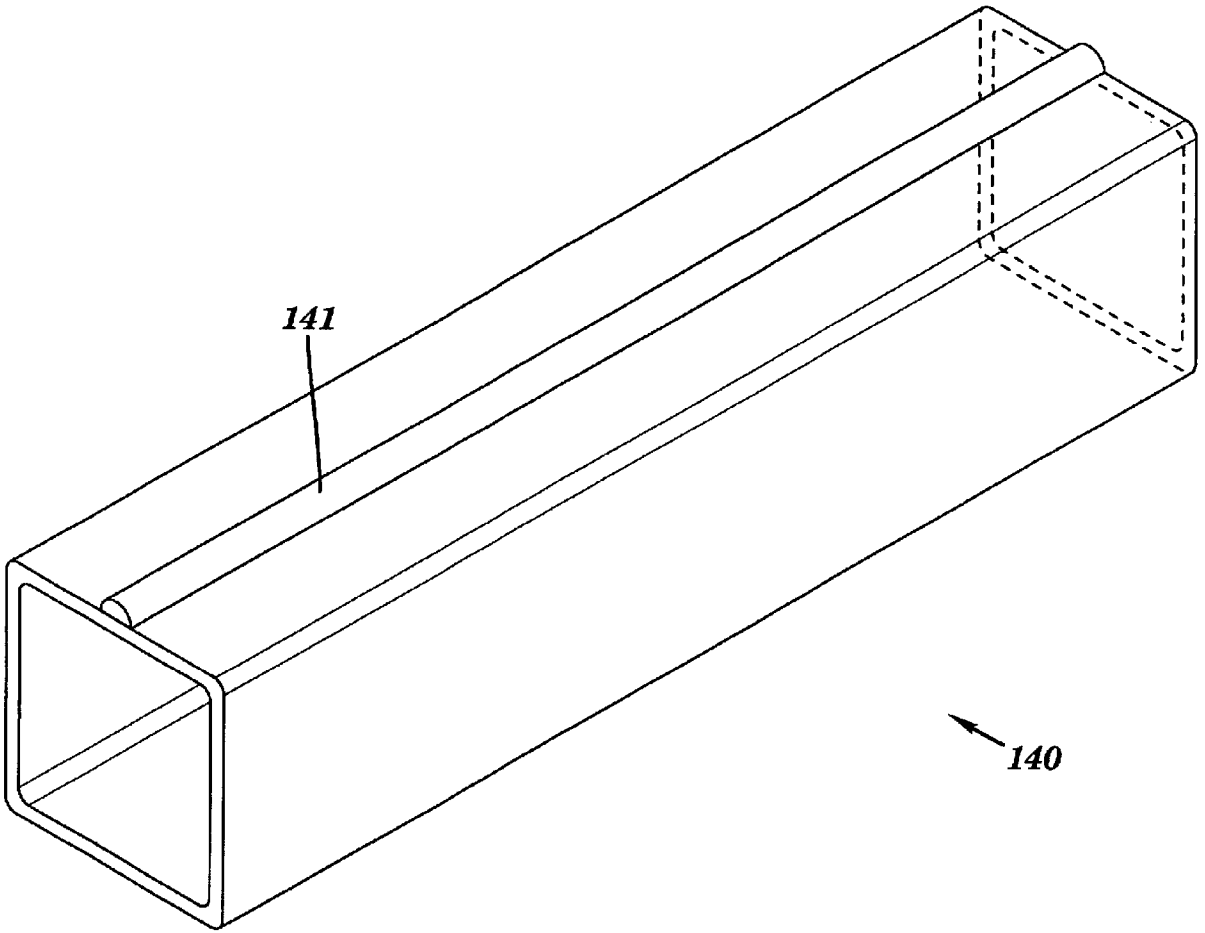
FIG. 20 depicts a perspective view of a moveable jacking beam portion of a forming system in accordance with the present invention.

A perspective view of a typical jacking, or floating, beam 140 is depicted in FIG. 20. This particular embodiment of the jacking beam 140 has a half round 141 on the top of the jacking beam 40. The half round 141 assists in providing a narrower point of contact between the jacking beam 140 and the bottom of the form sections 170, to which the jacking beam 140 will provide the adjusting force. Although a square tube shape is shown for the jacking beam 140, other shapes and configurations can be employed.

Figure 21A:
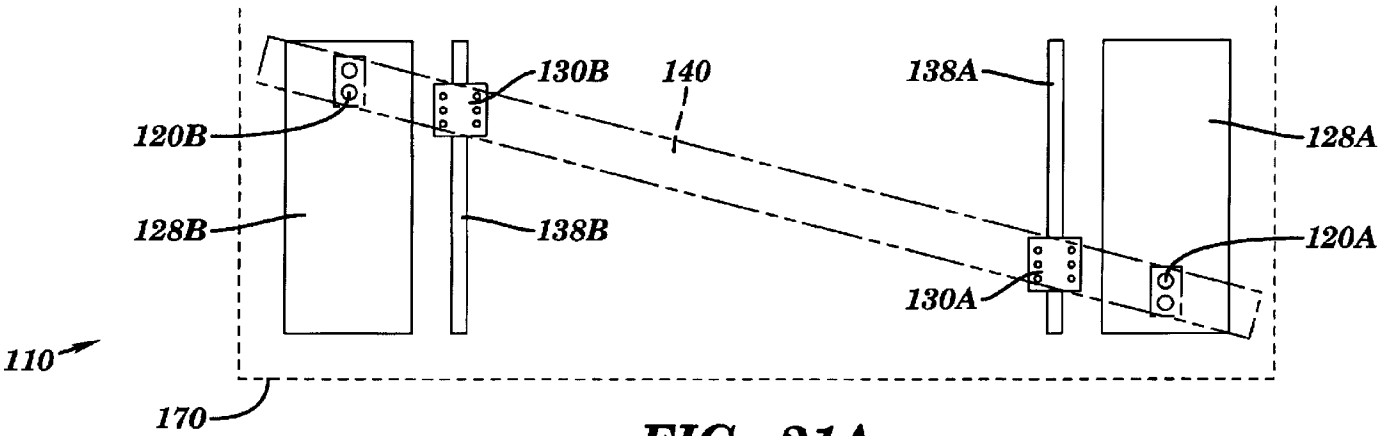
FIG. 21A depicts a plan view of a portion of a forming system in accordance with the present invention.
Figure 21B:
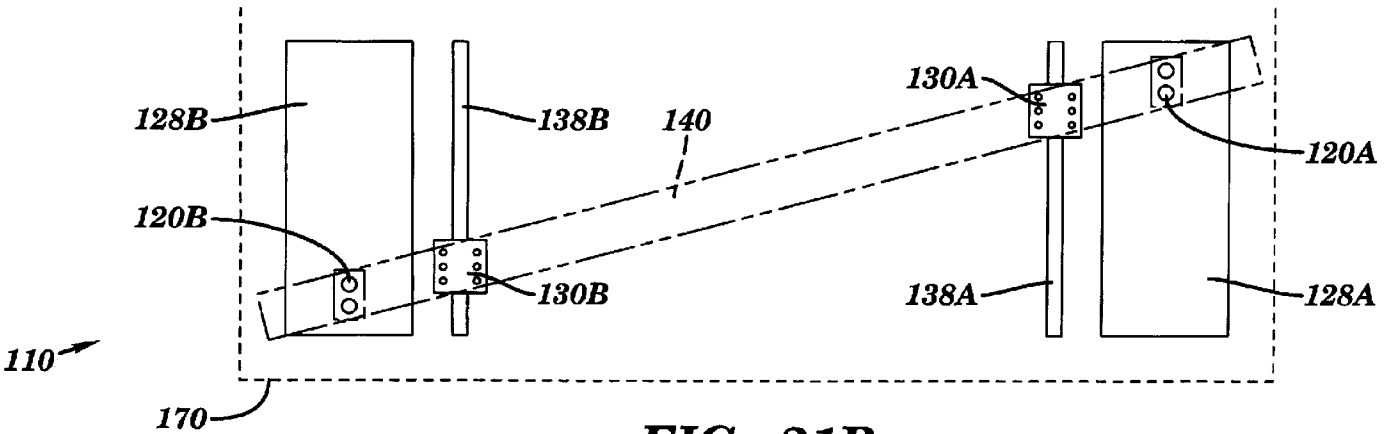
FIG. 21B depicts a plan view of a portion of a forming system in accordance with the present invention.

FIGS. 21A and 21B shows a plan view of a portion of the forming system 110. A portion of the form sections 170 are shown in phantom. The plurality of mobile jacking trolleys 120A, 120B can move within trolley tracks 128A, 128B respectively. Similarly, the jacking beam 140 is moved laterally into place via a plurality of roller assemblies 130A, 130B which ride on roller tracks 138A, 138B respectively. When the jacking beam 140 is not in contact with the form sections 170, the jacking beam 140 can be moved to the desired placement location, via the pair of roller assemblies 130A, 130B. The roller assemblies 130A, 130B operate along the pair of roller tracks 138A, 138B. Similarly, the mobile jacking trolleys 120A, 120B operate along a pair of trolley tracks 128A, 128B. Thus, the jacking beam 140 can be moved into a plurality of locations under the form sections 170, only two of which are shown in FIGS. 21A and 21B, depending on the desired plan view dimensions of the slab 100. This is done by moving the roller assemblies 130A, 130B along the roller tracks 138A, 138B. Once the jacking beam 140 is in the desired location, at least one of the series of mobile jacking trolleys 120A, 120B can be employed to adjust the jacking beam 140 out of level, thereby causing the forming system 110 to become warped.

Figure 22B:
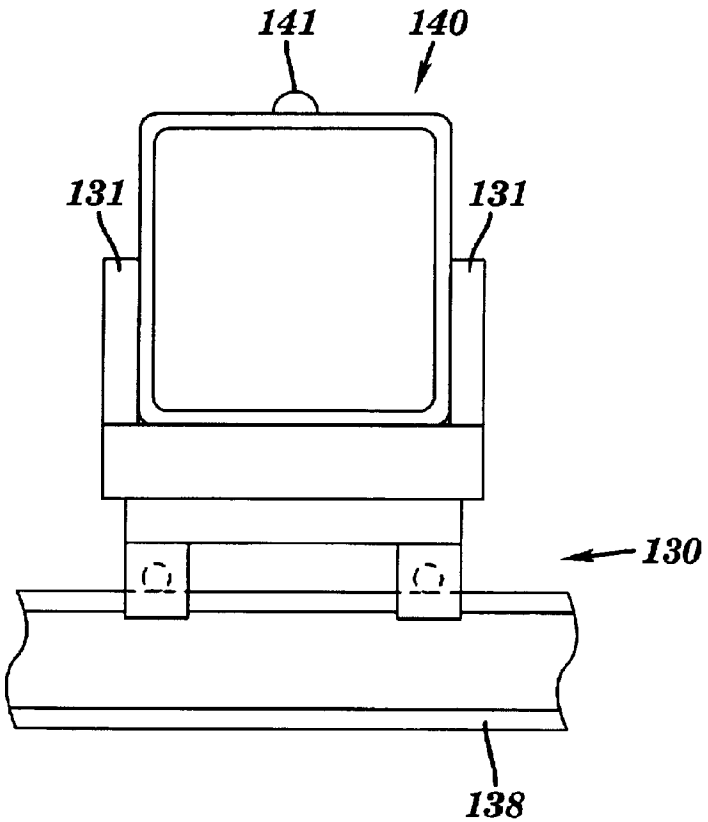
FIG. 22B depicts a side view of a roller assembly portion of a forming system in accordance with the present invention.
Figure 22A:
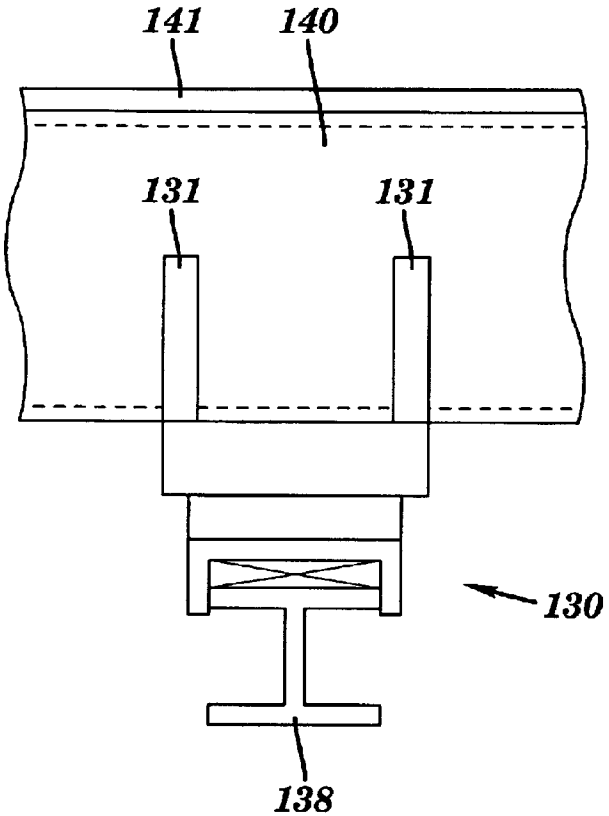
FIG. 22A depicts a side view of a roller assembly portion of a forming system in accordance with the present invention.

FIGS. 22A and 22B depict side views of a typical roller assembly 130 operating along the roller track 138. The roller assembly 130 includes a roller assembly 130, for example made by Hilman (Hilman Rollers of Marlboro, N.J.), and a plurality of extensions 131 which assist in keeping the jacking beam 140 in place over the roller assembly 130 during its movement along the roller track 138. Although a wide flange beam 138 is depicted, other various shapes and items can be used for the roller track 138.

Figure 23B:
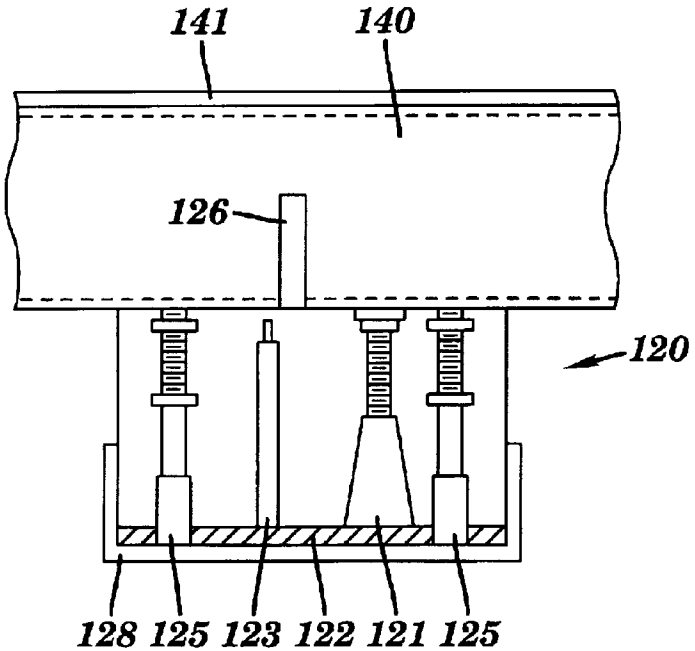
FIG. 23B depicts a side view of a mobile jacking trolley portion of a forming system in accordance with the present invention.
Figure 23A:
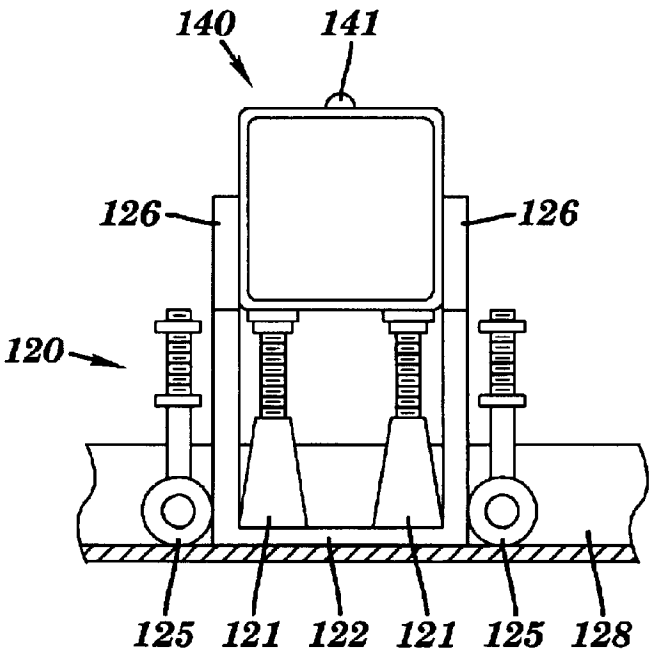
FIG. 23A depicts a side view of a mobile jacking trolley portion of a forming system in accordance with the present invention.

FIGS. 23A and 23B similarly depict side views of the mobile jacking trolleys 130. The mobile jacking trolleys 130 are used to adjust a portion of the jacking beam 140 out of level, either by lowering or raising the jacking beam 140 out of level. The out of level jacking beam 140, in turn, via its contact through the half round 141 can adjust the forming sections 170 such that it becomes warped. The mobile jacking trolleys 120 includes a plurality of spring-loaded casters 125 attached to a trolley base 122 on which resides a plurality of devices. On the trolley base 122 are a plurality of hydraulic cylinders 123 and screw jacks 121. The hydraulic cylinders 123 can provide lifting means to the jacking beam 140. The screw jacks 121 can hold the jacking beam 140 in place, once the hydraulic cylinders 123 have lifted the jacking beam 140 to the appropriate elevation. The beam followers 126 assist in keeping the jacking beam 140 over the jacking trolleys 120. The mobile jacking trolleys 120 operates within the trolley track 128. Although a straight C-section is shown as the trolley track 128, other shapes and configurations can be employed for the device which the mobile jacking trolleys 120 travel on. Likewise, various devices can be used on the jacking trolley 120. For example, in lieu of hydraulic cylinders 123, mechanical jacks could be employed to provide lifting forces to the jacking beam 140.

Figure 24A:
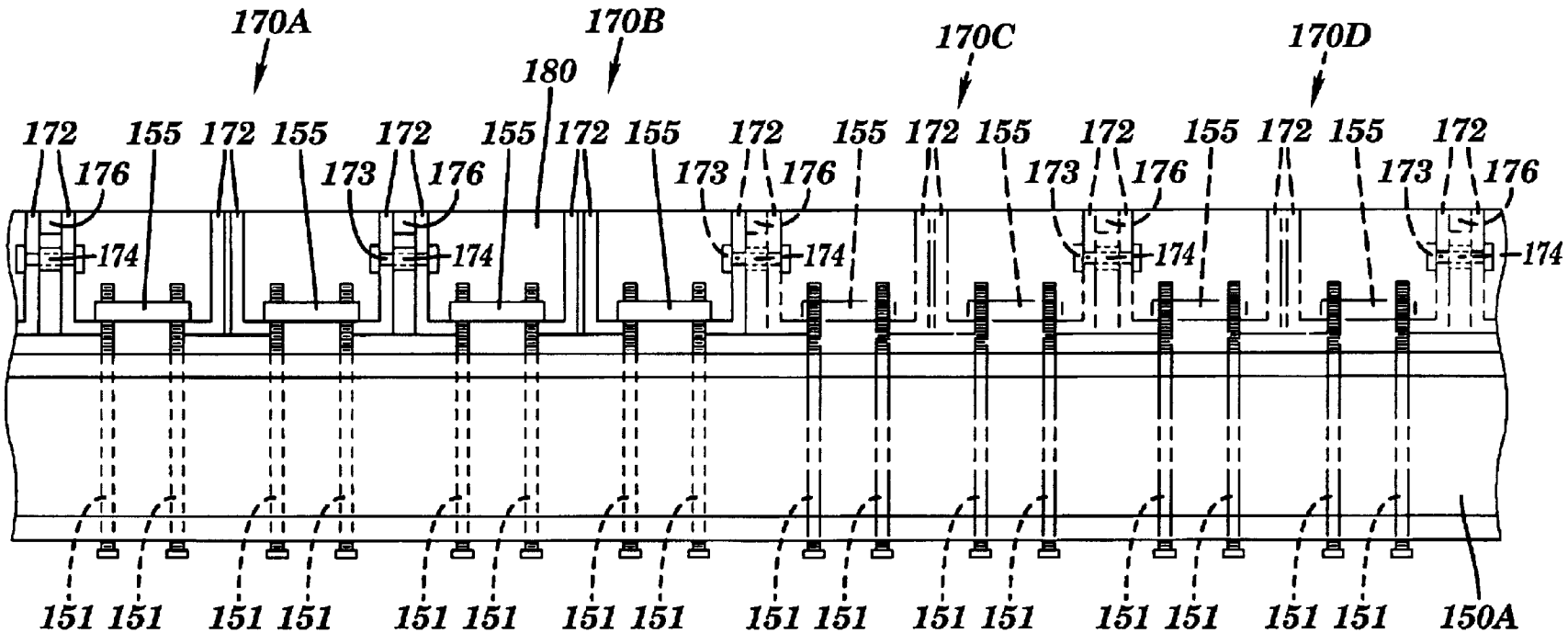
FIG. 24A depicts a side view of a portion of a forming system in accordance with the present invention.
Figure 24B:
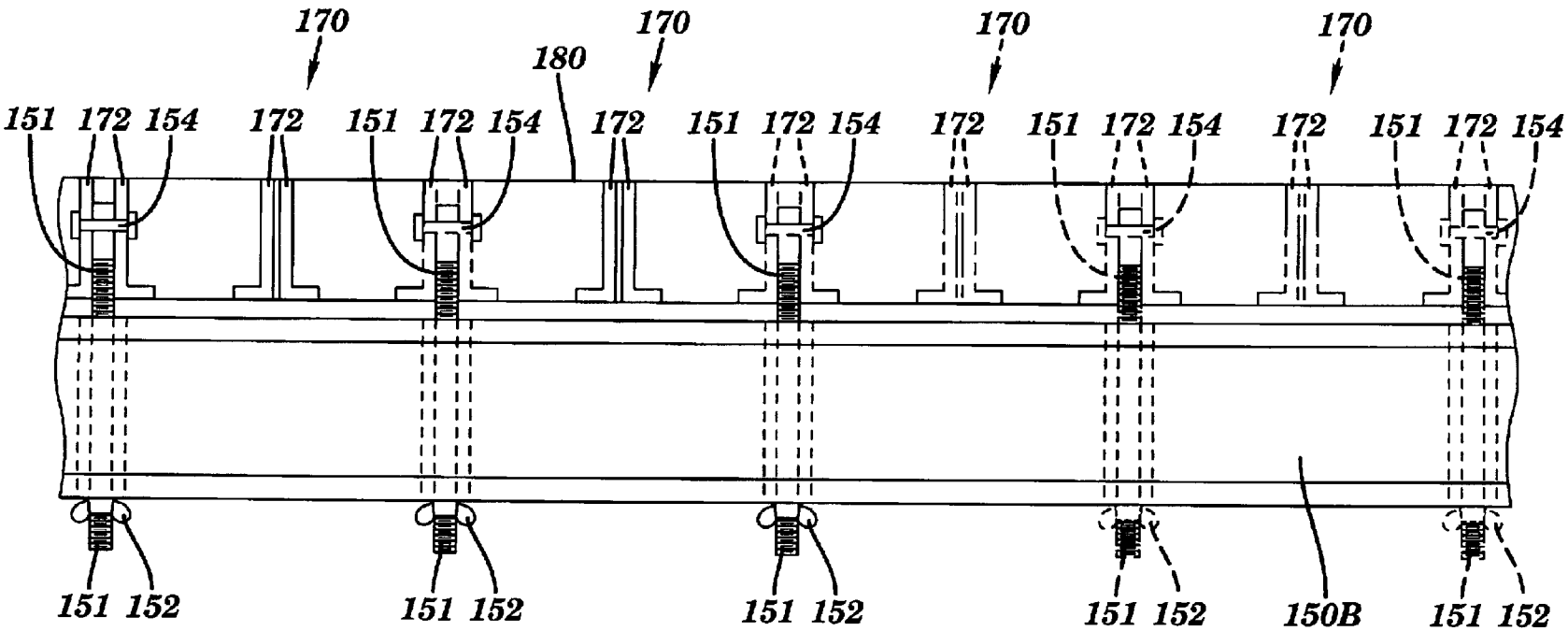
FIG. 24B depicts a side view of a portion of a forming system in accordance with the present invention.

FIGS. 24A and 24B show cross-sectional views of a portion of the forming system 110. FIG. 24A shows a side view of the first support beam 150A. FIG. 24B shows a side view of the second support beam 150B. The first support beam 150A is connected to the plurality of form sections 170. Adjacent form sections 170 (e.g., 170A, 170B) are connected via bolts 173 at the stiffeners 172. A series of spacers 174 are placed between adjacent form sections 170. The spacers 174 provide a space between form sections 170 in which is inserted a nailing strip 176 for attaching grout channel formers (not shown) to form sections 170. The nailing strips 176 may be made from wood strips or light gage steel tubes or other similar material. The spacers 174 also provide flexibility, in part, between form sections 170 and allow the form sections 170 to warp. The stiffeners 172, which are L-shaped, have attached to their shorter leg a plurality of clamp tubing 155. The clamp tubing 155, which can be square tubes, are in turn attached via a plurality of bolts 151 to the support beam 150A. Thus, the first support beam 150A is attached to the plurality of form sections 170 via the system of bolts 151 and clamp tubing 155.

FIG. 24B shows the connecting details of the second support beam 150B to the plurality of form sections 170. Between each form section 170, is a clevis 154, threaded rod 151, and wing nut 152 arrangement. Because the second support beam 150B is at the end of the forming system 110 which will be placed out of level (i.e., raised or lowered) the clevis 154 configuration allows for angulation of the end of the forming system 110 which resides nearer the second support beam 150B.

Figure 25:
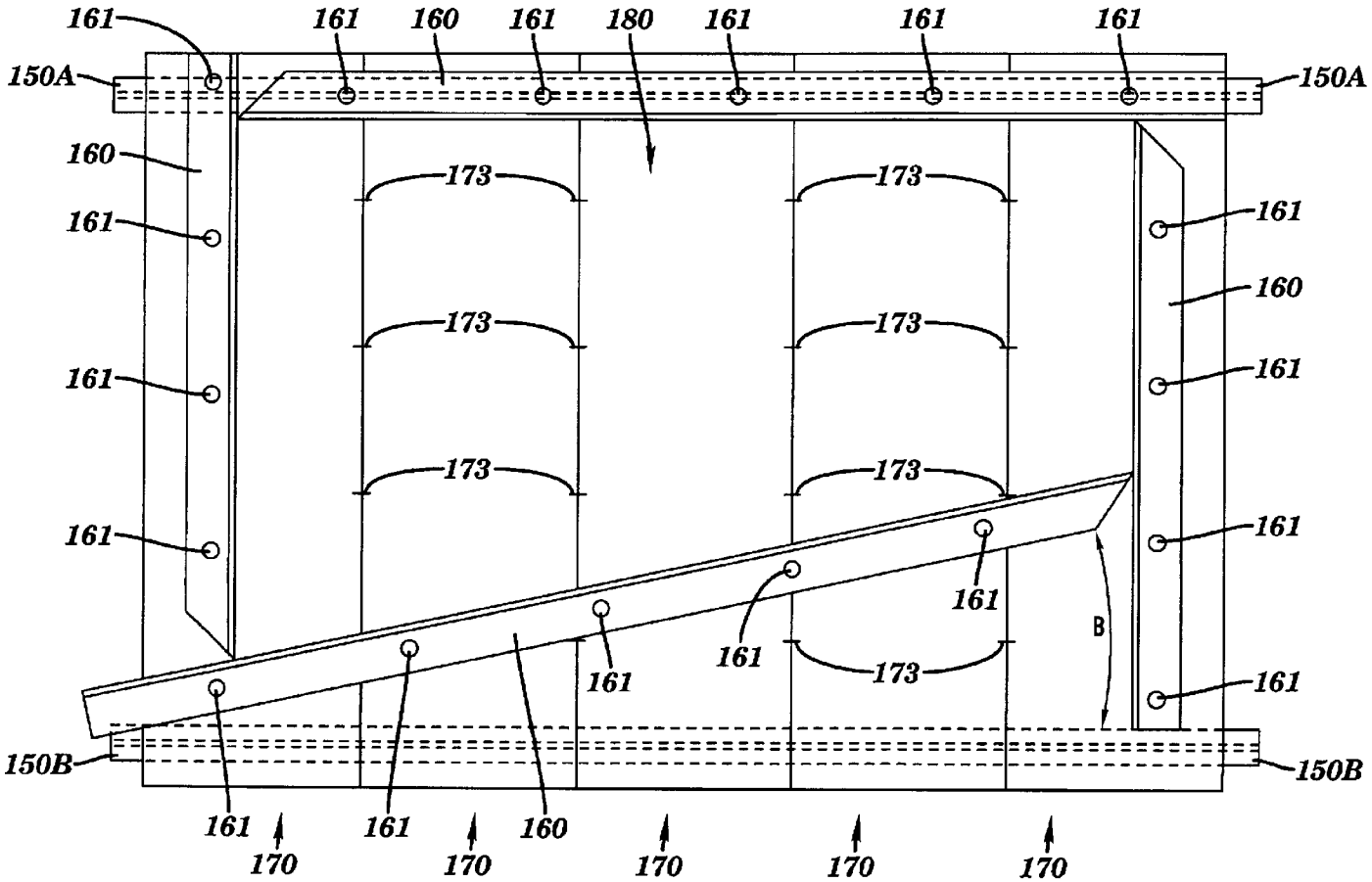
FIG. 25 depicts a plan view of a portion of a forming system in accordance with the present invention.
Figure 26:
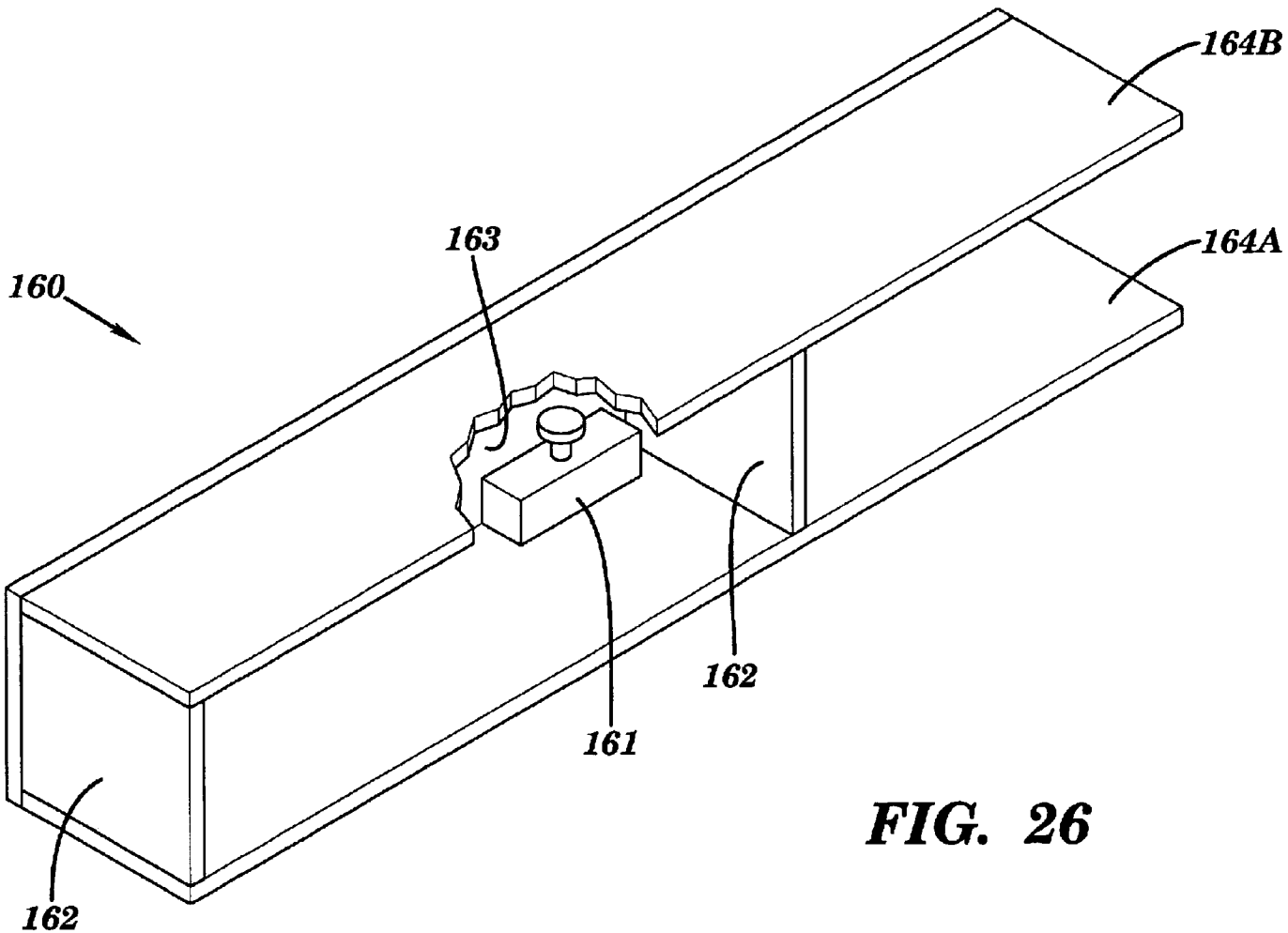
FIG. 26 depicts a perspective view of a portion of a side rail of a forming system in accordance with the present invention.

FIG. 25 depicts a plan view of the forming system 110. On the top of the form sections 170 is a casting deck 180. Residing on the top of the casting deck 180 are a plurality of movable side rails 160. The side rails 160 are movable, as denoted by directional arrow "B", so that they can match both the shape of the desired warped slab 100 and the location of the jacking beam 140 below. As the perspective view in FIG. 26 shows, each side rail 160 is L-shaped in cross section. A vertical face 163 is connected to a horizontal base 164A and a horizontal top rail 164B. Additional vertical gussets 162 provide additional strength to the side rail 160. The vertical faces 163 of all the side rails 160 are perpendicular, at all points, to the casting deck 180. Located on the base 164 are a plurality of magnets 161, such as the "EZY-STRYP" Button Magnet made by Spillman (Spillman Inc. of Columbus, Ohio). The magnets 161 provide a simple, quck and non-penetrating attachment to form sections 170. Other types of clamping devices may clamp abutting side rail 160 sections together to form a more positive connection. Within the space between the side rails 160 is placed a hardenable, flowable material, such as concrete for forming into the final warped slab 100.

It should be apparent to one skilled in the art that the form system 110, while able to make warped pavement slabs 100, can be used just as readily make a flat (i.e., non-warped) pavement slab 10. Similarly, the various devices, appurtenances, methods, and pavement systems disclosed above for use with a flat pavement slab 10, can readily by applied as well in making and installing the warped pavement slab 100.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

I claim:

1. An apparatus comprising:

a pre-fabricated pavement slab of uniform thickness formed of a hardenable, flowable material, wherein said pre-fabricated pavement slab is warped, wherein all the edges of the slab are straight, wherein an edge is the line of intersection between a top surface of the slab or a bottom surface of the slab and a side plane of the slab, further wherein if a non-perpendicular cross section is taken of the warped slab, the resultant edges will be non-linear, wherein resultant edges are either line at a top surface or bottom surface of the cross-sectional cut of the slab.

2. The apparatus as in claim 1, wherein at least one side is a plumb surface.

3. The apparatus as in claim 1, wherein all sides are plumb surfaces.

4. The apparatus as in claim 1, wherein at least one end is a plumb surface.

5. The apparatus as in claim 1, wherein a top surface of the slab is warped; and a bottom surface of the slab is warped and parallel to the top surface.

6. The apparatus as in claim 1, wherein at least one resultant edge of a cross-sectional cut taken perpendicular to a longitudinal side of the slab is straight, wherein the resultant edge is the line at a top surface or bottom surface of the cross-sectional cut of the slab.

7. An apparatus for interconnecting with an adjacent structure comprising:

a pre-fabricated pavement slab formed of a hardenable, flowable material, wherein said pre-fabricated pavement slab is warped, said slab further comprising at least one connector extending from a first end of the slab;

at least one mating interconnection formed within a second end thereof to receive at least one connector extending from said adjacent structure, wherein the at least one mating interconnection is accessible from a top surface of the slab; and a plurality of channels formed within a bottom surface of the slab, wherein at least one channel is accessible from the top surface of the slab.

8. The apparatus as in claim 7, further comprising at least one matins interconnection formed at a first and a second side.

9.The apparatus as in claim 8, wherein the at least one mating interconnections formed within the second ends and the first and second sides of the slab comprise inverted slots.

10. The apparatus as in claim 9, wherein the inverted slots have a rounded top section and at least one shear pin along a side of the slot.

11. The apparatus as in claim 9, wherein the inverted slots have a top width greater than a base width.

12. The apparatus as in claim 9, wherein the inverted slots have substantially vertically oriented sides, and where the sides have a roughened surface.

13. The apparatus as in claim 7, wherein a binder distribution system, accessible from the top surface of the slab, uniformly distributes grout to the bottom surface of the slab.

14. The apparatus as in claim 7, further comprising a gasket surrounding the perimeter of the slab on the bottom surface thereof.

15. A method for making a pre-fabricated warped pavement slab wherein said slab includes four corners said method comprising:

providing a plurality of form sections;

assembling said plurality of form sections into a form system, wherein said form system has four corners;

adjusting a first portion of the plurality of form sections relative to a second portion of the plurality of form sections so that only three of said four corners of said form system are coplanar; and placing a hardenable, flowable material onto the form system.

16. A precision pre-fabricated warped pavement slab comprising:

the pre-fabricated pavement slab formed of a hardenable, flowable material, wherein a top surface of the pavement slab is warped; and both resultant edges of a cross section cut taken perpendicular to a longitudinal side are straight, wherein a resultant edge is the line at the top surface or a bottom surface of the cross-sectional cut of the slab, further wherein if a non-perpendicular cross section is taken of the warped slab, the resultant edges will be non-linear.

17. The pavement slab as in claim 16, wherein the thickness of the slab is essentially uniform.

* * * * *

UNITED STATES PATENT AND TRADEMARK OFFICE

CERTIFICATE OF CORRECTION

PATENT NO. : 6,899,489 B2
DATED : May 31, 2005
INVENTOR(S) : Smith, Peter J.

It is certified that error appears in the above-identified patent and that said Letters Patent is hereby corrected as shown below:

Column 11,
Line 2, delete “ton” and insert -- top --.

Column 15,
Line 22, delete “matins” and insert -- mating --.

Signed and Sealed this

Sixth Day of September, 2005

JON W. DUDAS
*Director of the United States Patent and Trademark Office*